US008955951B2

(12) United States Patent
Aoki et al.

(10) Patent No.: US 8,955,951 B2
(45) **Date of Patent: *Feb. 17, 2015**

(54) CARTRIDGE AND PRINTING DEVICE

(71) Applicant: Seiko Epson Corporation, Tokyo (JP)

(72) Inventors: Yuji Aoki, Nagano (JP); Hiroshi Satoh, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/140,934

(22) Filed: Dec. 26, 2013

(65) Prior Publication Data

US 2014/0104351 A1 Apr. 17, 2014

Related U.S. Application Data

(63) Continuation of application No. 13/736,499, filed on Jan. 8, 2013, now Pat. No. 8,646,889.

(30) Foreign Application Priority Data

Jan. 13, 2012 (JP) ..... 2012-005347
Jan. 25, 2012 (JP) ..... 2012-013238
Feb. 6, 2012 (JP) ..... 2012-023430

(51) Int. Cl.
*B41J 2/175* (2006.01)

(52) U.S. Cl.
CPC ..... *B41J 2/1752* (2013.01); *B41J 2/17509* (2013.01); *B41J 2/17553* (2013.01); *B41J 2/17503* (2013.01)
USPC ..... 347/86

(58) Field of Classification Search
USPC ..... 347/84–87
See application file for complete search history.

(56) References Cited

U.S. PATENT DOCUMENTS

| | | | |
|---|---|---|---|
| 5,896,151 | A | 4/1999 | Miyazawa et al. |
| 6,106,112 | A | 8/2000 | Okubo et al. |
| 6,220,702 | B1 | 4/2001 | Nakamura et al. |
| 6,435,673 | B1 | 8/2002 | Hattori et al. |
| 6,591,874 | B2 | 7/2003 | Credle, Jr. |
| 6,609,789 | B1 | 8/2003 | Hunt |
| 7,377,627 | B2 | 5/2008 | Muranaka et al. |
| 7,814,656 | B2 | 10/2010 | Prasad |

(Continued)

FOREIGN PATENT DOCUMENTS

| | | | |
|---|---|---|---|
| CA | 2782610 | A1 | 12/2011 |
| CN | 101130309 | A | 2/2008 |

(Continued)

*Primary Examiner* — Kristal Feggins
(74) *Attorney, Agent, or Firm* — Global IP Counselors, LLP

(57) ABSTRACT

An attachment member is adapted to be mounted to a mounting section of a printing apparatus from an outside toward an inward direction of the printing apparatus. The mounting section extends from a connecting position of a printing material supply pipe arranged inside of the printing apparatus to the outside of the printing apparatus with a lever being disposed at a position closer to the outside. The attachment member includes a front surface and an upper surface. The front surface has a supply pipe insertion hole to which the printing material supply pipe is inserted. The upper surface intersects with the front surface. The upper surface includes a concave section formed thereon so that a regulating section of the lever is inserted into the concave section when the attachment member is mounted to the mounting section.

12 Claims, 26 Drawing Sheets

(56) References Cited

U.S. PATENT DOCUMENTS

| | | | | |
|---|---|---|---|---|
| 8,011,772 | B2 * | 9/2011 | Kimura et al. | 347/86 |
| D656,184 | S | 3/2012 | Iwamuro et al. | |
| 8,141,998 | B2 * | 3/2012 | Nozawa et al. | 347/86 |
| 8,197,045 | B2 | 6/2012 | Takeuchi | |
| D682,929 | S | 5/2013 | Aoki et al. | |
| D682,930 | S | 5/2013 | Aoki et al. | |
| D682,931 | S | 5/2013 | Aoki et al. | |
| 8,454,142 | B2 * | 6/2013 | Bannai et al. | 347/86 |
| 8,646,889 | B2 * | 2/2014 | Aoki et al. | 347/86 |
| D712,466 | S | 9/2014 | Nagashima et al. | |
| 2003/0234844 | A1 | 12/2003 | Yamamoto et al. | |
| 2006/0012638 | A1 | 1/2006 | Lee | |
| 2006/0038865 | A1 | 2/2006 | Nagasaki et al. | |
| 2006/0238581 | A1 | 10/2006 | Yoshimura et al. | |
| 2008/0049081 | A1 | 2/2008 | Hayashi et al. | |
| 2008/0151018 | A1 | 6/2008 | Aoki et al. | |
| 2008/0198211 | A1 | 8/2008 | Aoki et al. | |
| 2008/0252669 | A1 | 10/2008 | Aoki et al. | |
| 2008/0252702 | A1 | 10/2008 | Aoki et al. | |
| 2008/0316249 | A1 | 12/2008 | Aoki et al. | |
| 2009/0064501 | A1 | 3/2009 | Kimura et al. | |
| 2009/0289971 | A1 | 11/2009 | Gilson et al. | |
| 2009/0303299 | A1 | 12/2009 | Gilson et al. | |
| 2011/0198360 | A1 | 8/2011 | Aoki | |
| 2011/0199439 | A1 | 8/2011 | Aoki | |
| 2012/0147102 | A1 | 6/2012 | Aoki et al. | |
| 2012/0200646 | A1 | 8/2012 | Karasawa et al. | |
| 2012/0200871 | A1 | 8/2012 | Takahashi et al. | |
| 2012/0212526 | A1 | 8/2012 | Karasawa et al. | |
| 2012/0242762 | A1 | 9/2012 | Gilson et al. | |
| 2013/0182050 | A1 | 7/2013 | Aoki et al. | |
| 2013/0182051 | A1 | 7/2013 | Aoki et al. | |
| 2013/0186513 | A1 | 7/2013 | Aoki et al. | |
| 2013/0187993 | A1 | 7/2013 | Aoki et al. | |
| 2013/0188985 | A1 | 7/2013 | Takahashi et al. | |
| 2013/0194357 | A1 | 8/2013 | Karasawa et al. | |
| 2013/0201260 | A1 | 8/2013 | Aoki et al. | |
| 2013/0223877 | A1 | 8/2013 | Takahashi et al. | |
| 2013/0278687 | A1 | 10/2013 | Karasawa et al. | |
| 2013/0307908 | A1 | 11/2013 | Aoki et al. | |

FOREIGN PATENT DOCUMENTS

| | | | |
|---|---|---|---|
| CN | 102036828 | A | 4/2011 |
| CN | 102285237 | A | 12/2011 |
| EP | 1504908 | A2 | 2/2005 |
| EP | 1547783 | A2 | 6/2005 |
| EP | 1892103 | A2 | 2/2008 |
| EP | 2308337 | A1 | 12/2011 |
| EP | 2397336 | A1 | 12/2011 |
| JP | 2003-266733 | A | 9/2003 |
| JP | 2004-195962 | A | 7/2004 |
| JP | 2007-083677 | A | 4/2007 |
| JP | 4843112 | B1 | 12/2011 |

* cited by examiner

CARTRIDGE AND PRINTING DEVICE

CROSS-REFERENCE TO RELATED APPLICATIONS

This is a continuation application of U.S. patent application Ser. No. 13/736,499 filed on Jan. 8, 2013. This application claims priority to Japanese Patent Application No. 2012-005347 filed on Jan. 13, 2012, Japanese Patent Application No. 2012-013238 filed on Jan. 25, 2012, and Japanese Patent Application No. 2012-023430 filed on Feb. 6, 2012. The entire disclosures of U.S. patent application Ser. No. 13/736,499, and Japanese Patent Application Nos. 2012-005347, 2012-013238 and 2012-023430 are hereby incorporated herein by reference.

TECHNICAL FIELD

The present invention relates to an attachment member adapted to be mounted to a printing apparatus.

PRIOR ART

Typically, cartridges which contain ink in an inner portion are mounted in printing apparatuses (ink jet printers) which use ink which is a printing material. For example, a flexible ink pack is arranged in an inner portion in the ink cartridge which is described in Japanese Unexamined Patent Application Publication No. 2004-195962 and Japanese Unexamined Patent Application Publication No. 2003-266733 and the inside of the ink pack is filled with the ink.

SUMMARY

In Japanese Unexamined Patent Application Publication No. 2004-195962, there is no mechanism which prevents the removal of the cartridge during use of the printing apparatus. As such, during the use of the printing apparatus, there is a concern that a user will pull out the cartridge by mistake.

On the other hand, in Japanese Unexamined Patent Application Publication No. 2003-266733, a mechanism is provided which prevents the removal of the cartridge during the use of the printing apparatus. However, regardless of whether the cartridge has a long depth dimension, the cartridge is set to be locked in the vicinity of the center of the dimension in the depth direction. In such a mechanism, there is a concern that the configuration may become complicated and the printing apparatus may be increased in size.

In view of the circumstances described above, the present invention has an object of providing a cartridge and a printing apparatus where it is possible to avoid an increase in size while preventing a user from pulling out the cartridge by mistake.

The present invention adopts the following means in order to solve at least a portion of the problems described above.

An attachment member according to one aspect is adapted to be mounted to a mounting section of a printing apparatus from an outside toward an inward direction of the printing apparatus. The mounting section extends from a connecting position of a printing material supply pipe arranged inside of the printing apparatus to the outside of the printing apparatus with a lever being disposed at a position closer to the outside. The attachment member includes a front surface and an upper surface. The front surface has a supply pipe insertion hole to which the printing material supply pipe is inserted. The upper surface intersects with the front surface. The upper surface includes a concave section formed thereon so that a regulating section of the lever is inserted into the concave section when the attachment member is mounted to the mounting section.

DESCRIPTION OF THE EMBODIMENTS

A cartridge 4 (one example of an attachment member) according to an embodiment of the present invention will be described.

Figure 1:
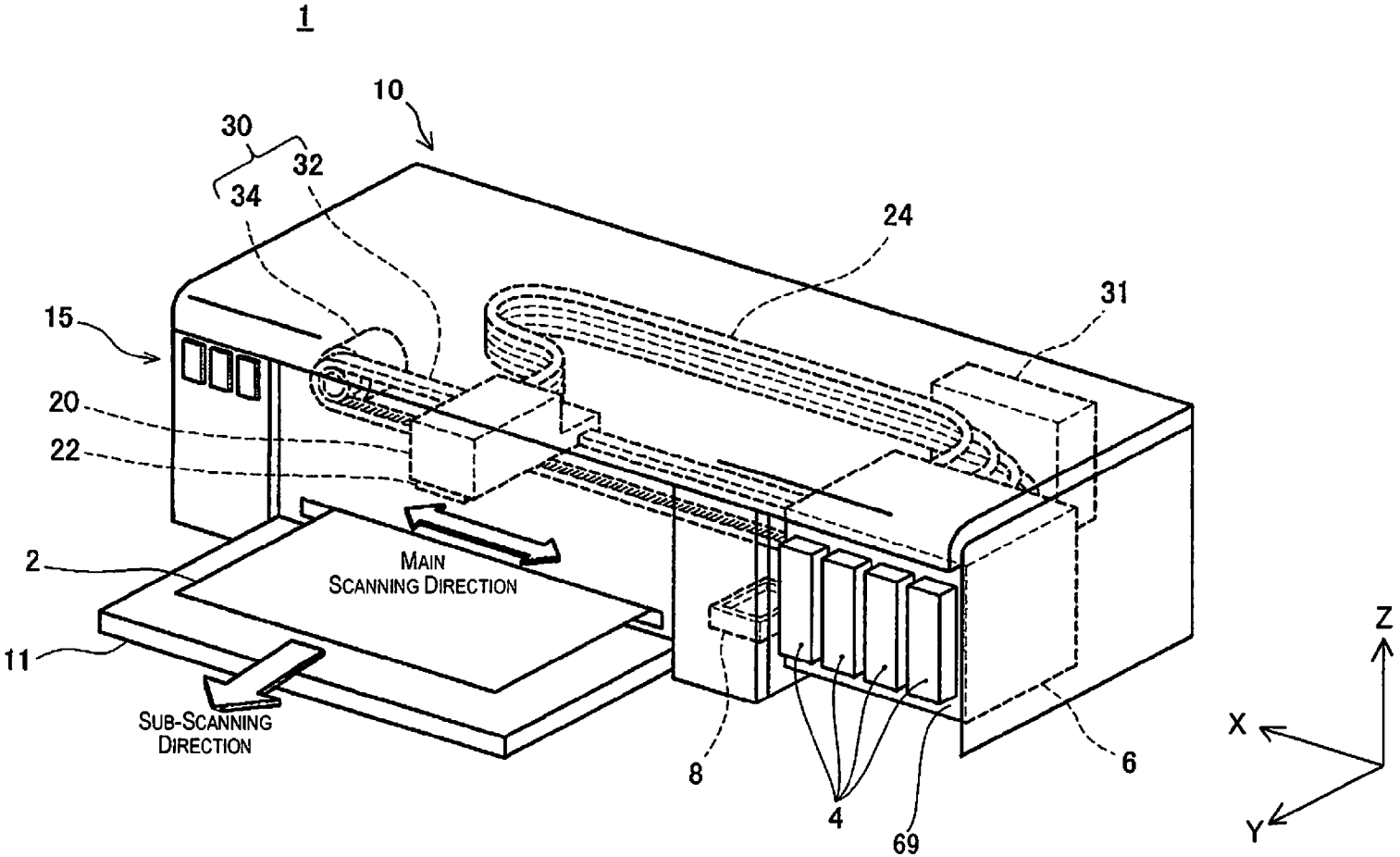
FIG. 1 is a perspective diagram illustrating a configuration of a printing material supply system 1.

FIG. 1 is a perspective diagram illustrating a configuration of a printing material supply system 1.

The printing material supply system 1 is provided with a printer 10 which is a printing apparatus and the cartridge 4.

In FIG. 1, XYZ axes which are three spatial axes perpendicular to each other are drawn. The directions following the arrows of the X axis, Y axis, and Z axis respectively show the positive directions along the X axis, Y axis, and Z axis. The positive directions along the X axis, Y axis, and Z axis are respectively set to the +X axis direction, the +Y axis direction, and the +Z axis direction. The opposing directions to the directions following the arrows of the X axis, Y axis, and Z axis are the negative directions respectively along the X axis, Y axis, and Z axis. The negative directions along the X axis, Y axis, and Z axis are respectively set to the −X axis direction, the −Y axis direction, and the −Z axis direction. The directions along the X axis, Y axis, and Z axis are respectively referred to as the X axis direction, the Y axis direction, and the Z axis direction, regardless of whether the directions are positive or negative.

The same applies to the diagrams which are shown below and the description. The XYZ axes which are drawn in other diagrams correspond to the directions of the XYZ axes of FIG. 1.

The printer 10 is an ink jet printer which discharges ink from a head 22. The printer 10 is a large scale printer which performs printing on large-sized paper (A2 to A0 or the like) such as posters. The printer 10 is provided with a cartridge mounting section 6, a control section 31, a carriage 20, the head 22, and a driving mechanism 30. In addition, the printer 10 is provided with operation buttons 15 for the user to operate actions of the printer 10.

A plurality of cartridges 4 are each mounted in the cartridge mounting section 6 so as to be able to be attached and detached. Four types of the cartridges 4 which correspond to inks of four colors (black, yellow, magenta, and cyan), that is, a total of four of the cartridges 4 are mounted in the cartridge mounting section 6 one by one.

In the printer 10, an insertion opening 69 side of the cartridge mounting section 6 is exposed to the front surface (the surface of the +Y axis direction side). A cover which covers the insertion opening 69 is not provided and the insertion opening 69 side is always exposed to the outside. As a result, it is possible to attach and detach the cartridge 4 in the printer 10 regardless of an opening and closing operation of a cover for the cartridge mounting section.

When the cartridge 4 is mounted in the cartridge mounting section 6, it is possible to supply ink to the head 22 which is provided in the carriage 20 through tubes 24.

Ink is supplied to the head 22 by suctioning the ink inside the cartridge 4 using a pump mechanism (which is not shown in the diagram) of the printer 10. Here, the tubes 24 are provided for every type of ink.

A state where the cartridge 4 is mounted in the cartridge mounting section 6 is also referred to as the "mounted state".

Nozzles are provided in the head 22 for every type of ink. The head 22 ejects ink toward printing paper 2 from the ejecting nozzles and prints data such as text, images, or the like.

The printer 10 is a printer which is referred to as a so-called "off-carriage type" in which the cartridge mounting section 6 is not linked to the movement of the carriage 20. It is also possible to apply the present invention to a printer which is referred to as a so-called "on-carriage type" in which the cartridge mounting section 6 is provided in the carriage 20 and the carriage 20 is moved along with the cartridge mounting section 6.

The control section 31 performs control of each of the sections of the printer 10 and sends and receives signals to and from the cartridge 4. The carriage 20 moves the head 22 relatively with regard to the printing paper 2.

The driving mechanism 30 reciprocally moves the carriage based on the control signal from the control section 31. The driving mechanism 30 is provided with a timing belt 32 and a driving motor 34. The carriage 20 is moved reciprocally in the main scanning direction (the X axis direction) by the movement of the driving motor 34 being transmitted to the carriage 20 through the timing belt 32. In addition, the printer 10 is provided with a transport mechanism for moving the printing paper 2 in the sub-scanning direction (the +Y axis direction). When printing is performed, the printing paper 2 is moved in the sub-scanning direction by the transport mechanism and the printing paper 2 is output onto a front surface cover 11 after the printing is complete.

In addition, a region which is referred to as the home position is provided at a position which is outside of the printing region where the carriage 20 is moved in the main scanning direction and a maintenance mechanism which performs maintenance such that printing is normally possible is mounted at the home position. The maintenance mechanism is configured by a cap member 8 which is pressed against a surface (a nozzle surface) where the nozzles are formed at the bottom surface side (the side which faces the printing paper 2) of the head 22 and which forms a closed space so as to surround the ejection nozzles, a elevating mechanism (which is not shown in the diagram) which raises and lowers the cap member 8 in order to press against the nozzle surface of the head 22, a suction pump (which is not shown in the diagram) which introduces a negative pressure into the closed space which is formed by the cap member 8 being pressed against the nozzle surface of the head 22, and the like.

In a state where the printing material supply system 1 (the printer 10 and the cartridge 4) is used, the axis which is along the sub-scanning direction in which the printing paper 2 is transported is set as the Y axis, the axis which is along the direction of gravity (the up and down direction) is set as the Z axis, and the axis which is along the movement direction (the left and right direction) of the carriage 20 is set as the X axis.

The "state where the printing material supply system 1 is used" refers to a state where the printing material supply system 1 is placed on a horizontal surface.

The sub-scanning direction (the forward direction) is set as the +Y axis direction and the opposing direction (the backward direction) is set to the −Y axis direction, and the direction (the upward direction) from the bottom to the top in the direction of gravity is set as the +Z axis direction and the opposing direction (the downward direction) is set to the −Z axis direction.

When the printing material supply system 1 is viewed from the front side (the +Y axis direction side), the direction which heads from the right side to the left side is set to the +X axis direction and the opposing direction is set to the −X axis direction.

Figure 2:
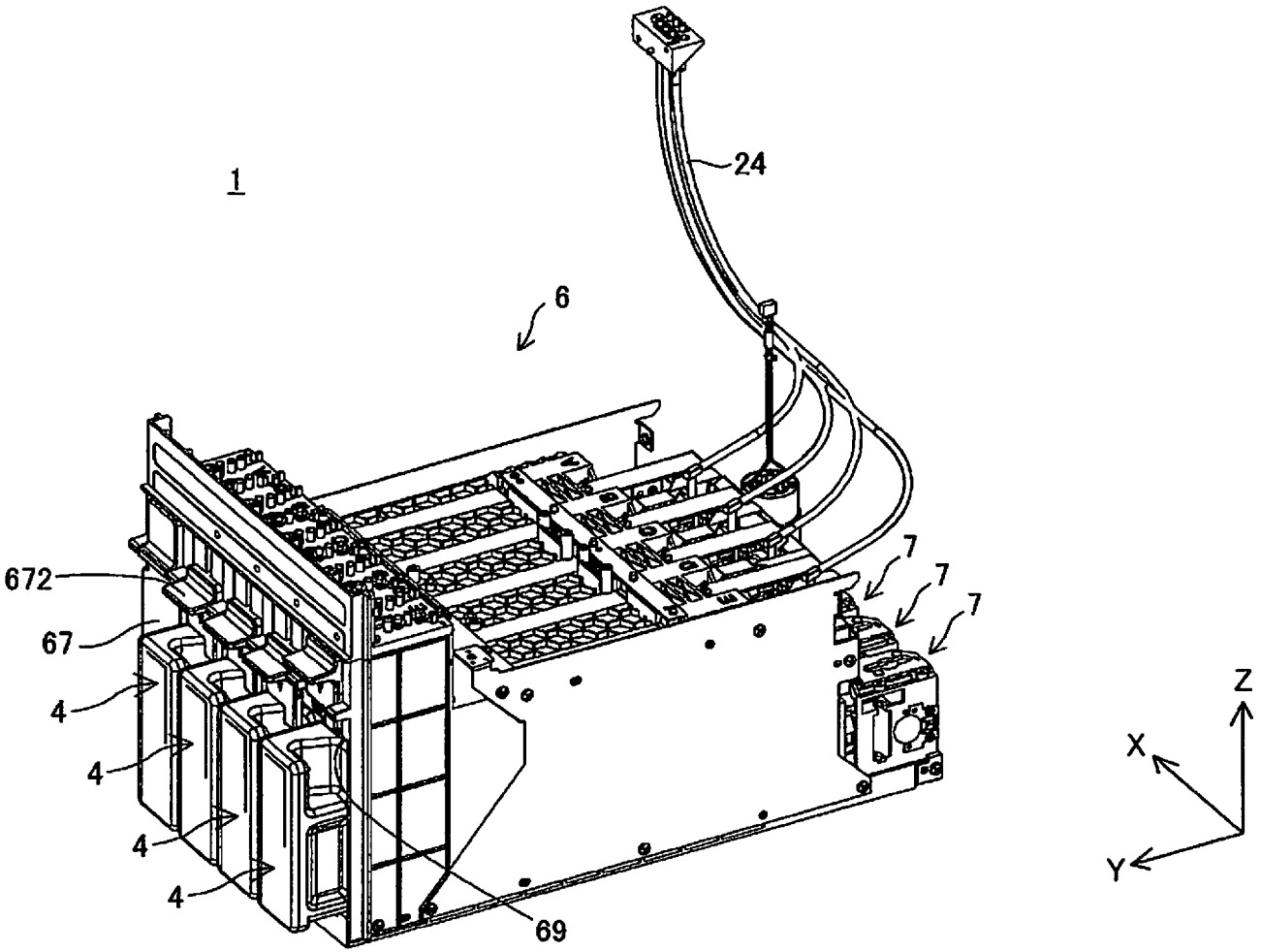
FIG. 2 is a perspective diagram of the external appearance illustrating a cartridge mounting section 6 in a cartridge mounting state.
Figure 3:
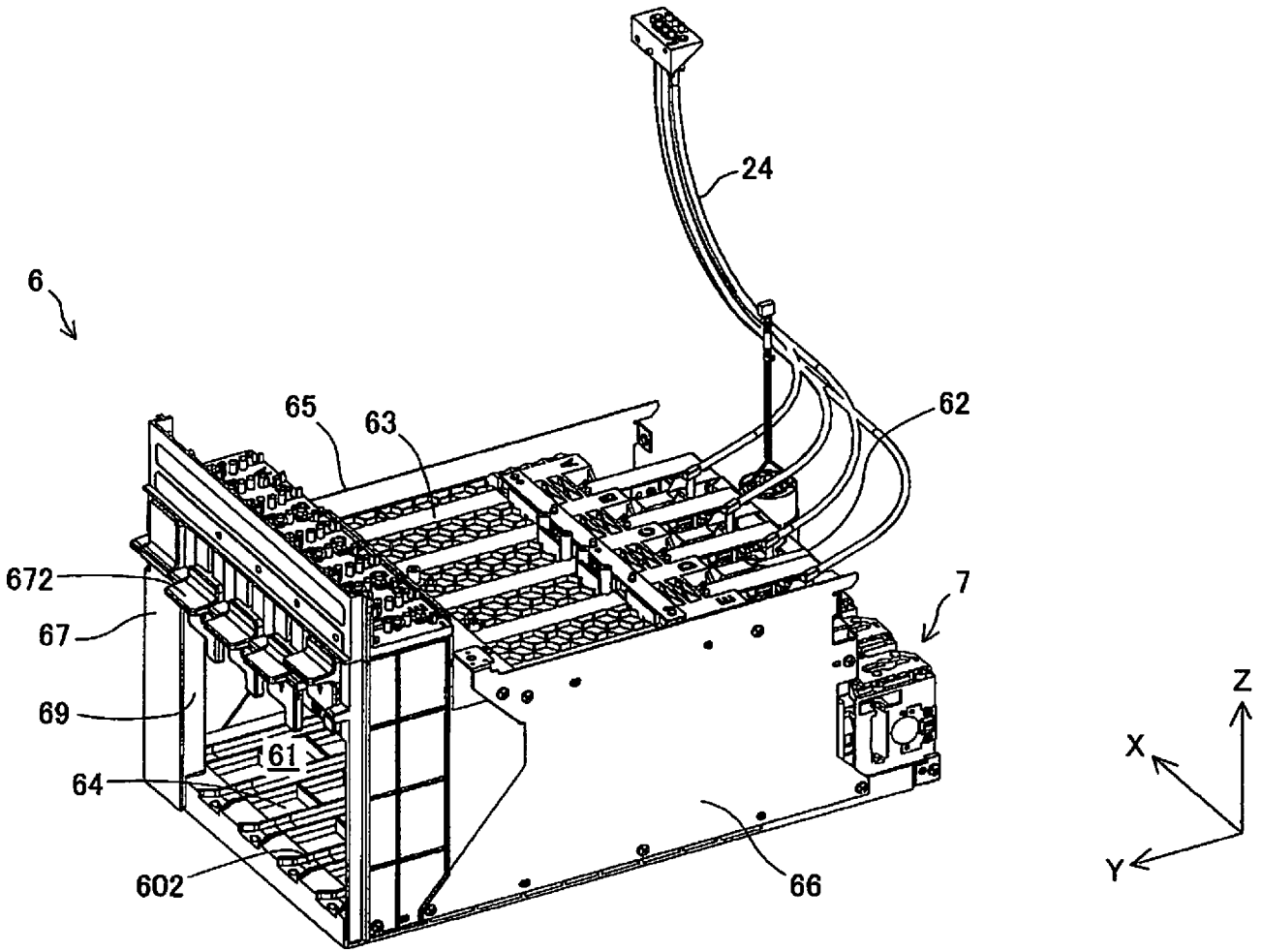
FIG. 3 is a first perspective diagram of the external appearance of the cartridge mounting section 6.
Figure 4:
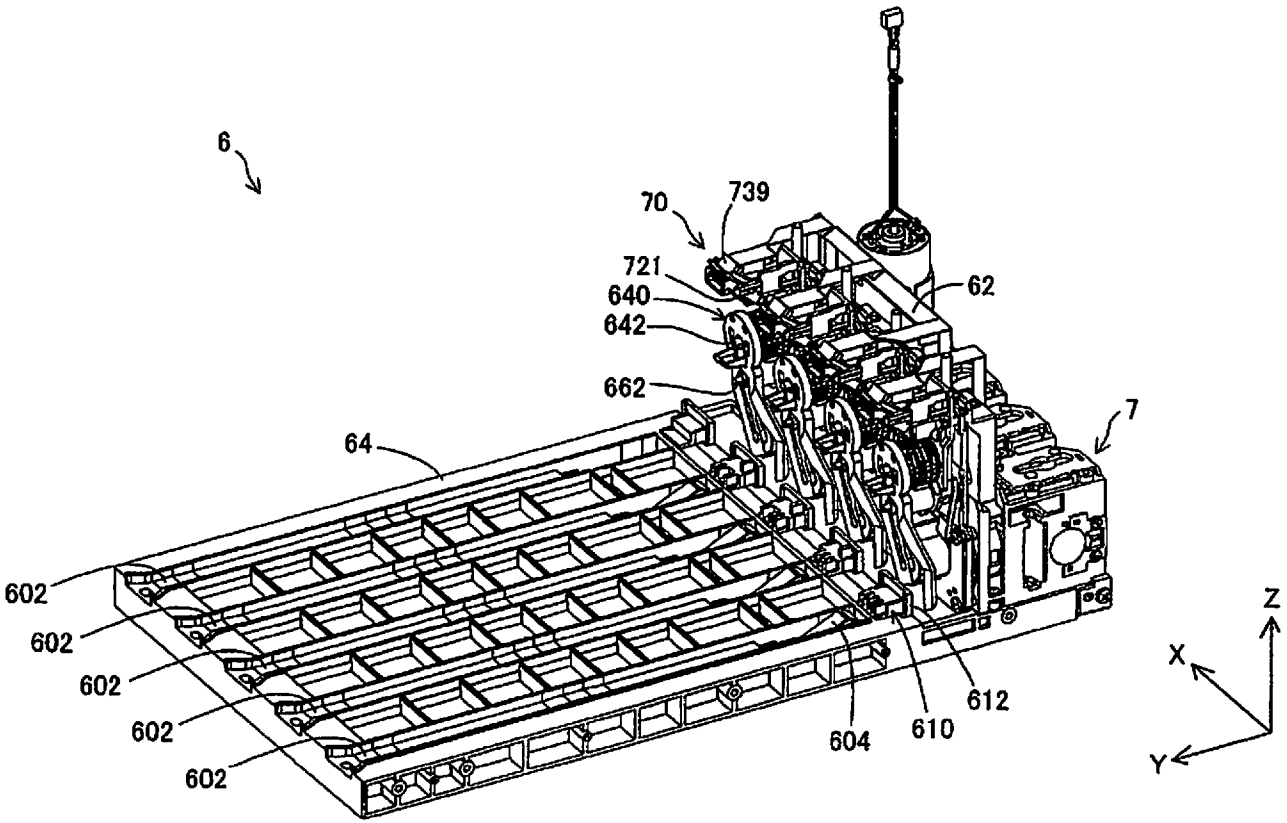
FIG. 4 is a second perspective diagram of the external appearance of the cartridge mounting section 6.
Figure 5:
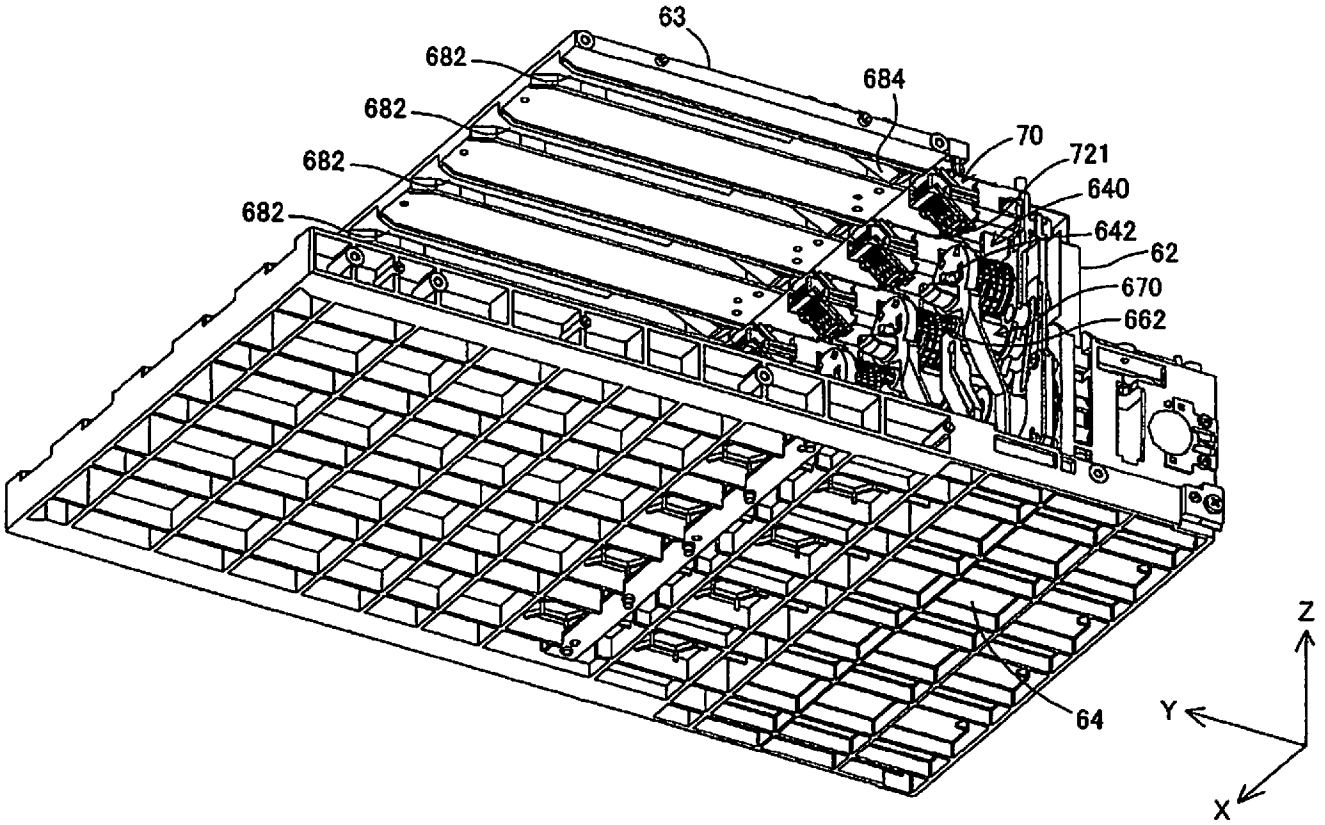
FIG. 5 is a third perspective diagram of the external appearance of the cartridge mounting section 6.

FIG. 2 is a perspective diagram of the external appearance illustrating the cartridge mounting section 6 in a cartridge mounting state. FIG. 3 is a first perspective diagram of the external appearance of the cartridge mounting section 6. FIG. 4 is a second perspective diagram of the external appearance of the cartridge mounting section 6. FIG. 5 is a third perspective diagram of the external appearance of the cartridge mounting section 6. The tube 24 which is attached to the cartridge mounting section 6 is illustrated in FIG. 3. FIG. 4 and FIG. 5 omit illustration of a portion of the configuration in order for the configuration of the inner portion of the cartridge mounting section 6 to be visible.

The ink of the cartridge 4 which is mounted in the cartridge mounting section 6 is circulated in the tube 24 by driving of a pump mechanism 7. In the cartridge mounting section 6, it is possible for four of the cartridges 4 to be independently attached and detached, but there may be a configuration where it is possible to increase the number of times that the cartridges 4 are attached and detached according to the specification of the printer 10. That is, as shown in FIG. 4, extra mounting spaces or members are provided at the far +X axis direction side such that it is possible to mount an increased number of the cartridges 4.

As shown in FIG. 3, in the cartridge mounting section 6, a cartridge containing chamber 61 which contains the cartridges 4 is formed by six wall sections which are described below. The cartridge containing chamber 61 has a substantially rectangular shape. The shape of the cartridge containing chamber 61 corresponds to the outer shape of the cartridge 4. Here, in the cartridge containing chamber 61, portions which contain one out of the four of the cartridges 4 are each referred to as slots.

The cartridge mounting section 6 is provided with an apparatus side front wall section 62, a first apparatus side side wall section 63, and a second apparatus side side wall section 64. In addition, the cartridge mounting section 6 is provided with a third apparatus side side wall section 65, a fourth apparatus side side wall section 66, and an opening wall section 67. The cartridge containing chamber 61 is formed and partitioned by the six wall sections 62, 63, 64, 65, 66, and 67. The outer shapes of the six wall sections 62, 63, 64, 65, 66, and 67 are each substantially rectangular shapes.

As shown in FIG. 3 and FIG. 4, the apparatus side front wall section 62 is positioned at the −Y axis direction side with regard to the cartridge containing chamber 61. The apparatus side front wall section 62 is a vertical wall section in the state where the printer 10 is used.

As shown in FIG. 4, an apparatus side terminal section 70, a printing material supply mechanism 640, and a rod 662 are provided in the apparatus side front wall section 62. In detail, the apparatus side terminal section 70, the printing material supply mechanism 640, and the rod 662 are lined up in order from the +Z axis direction to the −Z axis direction. The apparatus side terminal section 70 and the printing material supply system 640 are provided on the surface of the +Y axis direction side (the side where the cartridge containing chamber 61 is positioned) of the apparatus side front wall section 62. In addition, the rod 662 is provided so as to penetrate the apparatus side front wall section 62 in the Y axis direction. The pump mechanism 7 is provided at the −Y axis direction side (the side which is opposite to the cartridge containing chamber 61) of the apparatus side front wall section 62.

The printing material supply system 640 is provided with a printing material supply pipe 642 described above, and is used in order to circulate the ink inside the cartridge 4 to the printer 10 side. The apparatus side terminal section 70 is provided with an apparatus side terminal group 721 (FIG. 5) and a connector 739 (FIG. 4) which are described above and is used in order to electrically connect the cartridge 4 and the printer 10.

The apparatus side terminal section 70 as shown in FIG. 4 is provided more to the first apparatus side side wall section 63 side (the +Z axis direction side) than the printing material supply pipe 642. The rod 662 is used in order to detect a state where the ink has run out in the cartridge 4 at the printer 10 side. That is, the rod 662 configures a portion of the detection mechanism of the printer 10 which is described later. In addition, the rod 662 functions as a position aligning member for suppressing position deviation from the correct mounted position when the cartridge 4 is mounted in the cartridge mounting section 6.

As shown in FIG. 3, the first apparatus side side wall section 63 is positioned at the +Z axis direction side with regard to the cartridge containing chamber 61. The first apparatus side side wall section 63 is provided with an orientation which intersects with the apparatus side front wall section 62. The first apparatus side side wall section 63 is provided with an orientation which is perpendicular to the apparatus side front wall section 62. The first apparatus side side wall section 63 is a horizontal wall section in the state where the printer 10 is used. The first apparatus side side wall section 63 configures the upper surface of the cartridge mounting section 6.

In the present specifications, "intersect" has the meaning of a state of any one of (i) a state where two elements which intersect with each other and actually intersect, (ii) a state where one of the elements would intersect with the other element if extended, and (iii) a state where the elements would intersect with each other in a case where each of the elements is extended.

As shown in FIG. 5, the first apparatus side side wall section 63 has a first rail 682 for guiding the cartridge 4 up to the mounting position. The first rails 682 are provided to correspond to at least the number of cartridges 4 which are mounted. Four of the cartridges 4 which are actually mounted and a total of five of the first rails 682 with one spare are provided. The first rails 682 are grooves which extend in the Y axis direction and a portion of the cartridges 4 is inserted therein. In addition, a leaf spring 684 is provided as a locking member in the −Y axis direction side end portion of the first rail 682. In the mounted state, the cartridge 4 is prevented from being pulled out from the cartridge mounting section 6 by the leaf spring 684 locking with the cartridge 4.

As shown in FIG. 3 and FIG. 4, the second apparatus side side wall section 64 is positioned at the −Z axis direction side with regard to the cartridge containing chamber 61. The second apparatus side side wall section 64 opposes the first apparatus side side wall section 63 so as to interpose the cartridge containing chamber 61. The second apparatus side side wall section 64 is provided with an orientation which intersects with the apparatus side front wall section 62. The second apparatus side side wall section 64 is perpendicular to the apparatus side front wall section 62. The second apparatus side side wall section 64 is a horizontal wall section in the state where the printer 10 is used. The second apparatus side side wall section 64 configures the bottom surface of the cartridge mounting section 6.

As shown in FIG. 4, the second apparatus side side wall section 64 has a second rail 602 for guiding the cartridge 4 up to the mounting position. The second rails 602 are provided to correspond to at least the number of cartridges which are mounted.

In the same manner as the first rails 682, five of the second rails 602 are provided. The second rails 602 are grooves which extend in the Y axis direction and a portion of the cartridges 4 is inserted therein. In addition, a leaf spring 604 is provided as a locking member in the −Y axis direction side end portion of the second rail 602. In the mounted state, the cartridge is prevented from being pulled out from the cartridge mounting section 6 by the leaf spring 604 locking with the cartridge 4. The first rails 682 and the second rails 602 on which the same cartridge 4 is mounted are provided at positions which face each other so as to interpose the cartridge containing chamber 61.

The dimensions of the first rail 682 and the second rail 602 are different in the X axis direction. In detail, the first rail 682 has a smaller dimension in the X axis direction than the second rail 602. Due to this, the configuration is such that it is not possible to insert the cartridge 4 into the first and second rails 682 and 602 in a case where an attempt is made to insert the cartridge 4 into the cartridge mounting section 6 with the opposite orientation to the orientation of the Z axis direction by mistake. Due to this, it is possible to reduce the possibility that the cartridge 4 will be inserted into the cartridge mounting section 6 in a state where the orientation in the Z axis direction is the opposite orientation.

In addition, as shown in FIG. 4, in the second apparatus side side wall section 64, an apparatus side identification member 610 is provided at a position which is adjacent to the apparatus side front wall section 62. The apparatus side identification member 610 is provided to correspond to the number of cartridges which are mounted. Four of the apparatus side identification members 610 are provided. The apparatus side identification members 610 are used in order to identify whether or not the correct type (the color of ink) of the cartridge 4 is mounted in each of the slots of the cartridge containing chamber 61. Each of the apparatus side identification members 610 is formed with a different shape according to the color of the ink inside the cartridges 4 which are mounted.

In detail, each of the apparatus side identification members 610 is formed by at least one or more ribs and a pattern which is determined by the number and positions of the ribs is different according to the type of the cartridge 4. An identification member (also referred to as a "cartridge side identification member") which is formed by the ribs is also provided in the cartridge 4. The identification members of the cartridges 4 are also formed in different shapes according to the colors of the inks which are contained. Then, in a case where the correct type of the cartridge 4 is inserted into a slot, the apparatus side identification member 610 and the cartridge side identification member are engaged. On the other hand, in a case where the wrong type of the cartridge 4 is inserted into the slot, it is not possible for the apparatus side identification member 610 and the cartridge side identification member to be engaged. Due to this, it is possible to reduce the possibility that the wrong type of the cartridge 4 will be mounted in each of the slots of the cartridge mounting section 6.

In addition, as shown in FIG. 4, in the second apparatus side side wall section 64, regulating members 612 are provided in positions in the vicinity of the apparatus side front wall section 62. The regulating members 612 are provided to correspond to at least the number of cartridges 4 which are mounted. Five of the regulating members 612 are provided, but the number which is actually used is four. The regulating members 612 abut against the cartridges 4 when the cartridges 4 are inserted into the cartridge containing chamber 61 of the cartridge mounting section 6 from the insertion opening 69 (FIG. 3) of the +Y axis direction side toward the apparatus side front wall section 62 of the −Y axis direction side and reach the correct mounting position. Due to this, it is possible to reduce the possibility that the cartridges 4 will be further pushed in from the correct mounting position.

As shown in FIG. 3, the opening wall section 67 is positioned at the +Y axis direction side with regard to the cartridge containing chamber 61. The opening wall section 67 has the insertion opening 69 so that the cartridge 4 passes through when attaching and detaching the cartridge 4. The opening wall section 67 opposes the apparatus side front wall section 62 so as to interpose the cartridge containing chamber 61. The opening wall section 67 is provided with an orientation which intersects with the first apparatus side side wall section 63 and the second apparatus side side wall section 64. The opening wall section 67 is perpendicular to the first apparatus side side wall section 63 and the second apparatus side side wall section 64. The opening wall section 67 is a vertical wall section in the state where the printer 10 is used.

The opening wall section 67 is provided with a lever 672 (a fixing lever) which is able to move in the Z axis direction. The lever 672 is moved in the −Z axis direction after the cartridge 4 is mounted in the cartridge mounting section 6. Due to this, the lever 672 is caught in the cartridge 4 and the cartridge 4 is prevented from being removed by mistake. The state where the lever 672 is caught in the cartridge 4 is the state of FIG. 2 where three levers 672 are shown which correspond to three of the cartridges 4 which are positioned at the +X axis direction side.

As shown in FIG. 3, the third apparatus side side wall section 65 is positioned at the +X axis direction side with regard to the cartridge containing chamber 61. The third apparatus side side wall section 65 is provided with an orientation which intersects with the apparatus side front wall section 62, the first apparatus side side wall section 63, the second apparatus side side wall section 64, and the opening wall section 67. The third apparatus side side wall section 65 is perpendicular to the apparatus side front wall section 62, the first apparatus side side wall section 63, the second apparatus side side wall section 64, and the opening wall section 67. The third apparatus side side wall section 65 is a vertical wall section in the state where the printer 10 is used. The third apparatus side side wall section 65 configures a side surface of the cartridge mounting section 6.

As shown in FIG. 3, the fourth apparatus side side wall section 66 is positioned at the −X axis direction side with regard to the cartridge containing chamber 61. The fourth apparatus side side wall section 66 opposes the third apparatus side side wall section 65 so as to interpose the cartridge containing chamber 61. The fourth apparatus side side wall section 66 is provided with an orientation which intersects with the apparatus side front wall section 62, the first apparatus side side wall section 63, the second apparatus side side wall section 64, and the opening wall section 67. The fourth apparatus side side wall section 66 is perpendicular to the apparatus side front wall section 62, the first apparatus side side wall section 63, the second apparatus side side wall section 64, and the opening wall section 67. The fourth apparatus side side wall section 66 is a vertical wall section in the state where the printer 10 is used. The fourth apparatus side side wall section 66 configures a side surface of the cartridge mounting section 6.

It is possible to define the following relationship from the arrangement of each of the wall sections 62, 63, 64, 65, 66, and 67. The direction in which the apparatus side front wall section 62 and the opening wall section 67 or the insertion opening 69 are opposed is the Y axis direction. The direction from the opening wall section 67 or the insertion opening 69 to the apparatus side front wall section 62, that is, the direction in which the cartridge 4 is inserted (mounted) in the cartridge mounting section 6 is the −Y axis direction and the reverse, that is, the direction in which the cartridge 4 is pulled out of (removed from) the cartridge mounting section 6 is the +Y axis direction. The direction in which the first apparatus side side wall section 63 and the second apparatus side side wall section 64 are opposed is the Z axis direction. The direction from the first apparatus side side wall section 63 to the second apparatus side side wall section 64 is the −Z axis direction and the reverse is the +Z axis direction. The direction in which the third apparatus side side wall section 65 and the fourth apparatus side side wall section 66 are opposed is the X axis direction. The direction from the third apparatus side side wall section 65 to the fourth apparatus side side wall section 66 is the −X axis direction and the reverse is the +X axis direction.

Next, a schematic configuration of the cartridge 4 will be described using FIGS. 6 to 26. The XYZ axes which are given in the diagrams in which the cartridge 4 is illustrated correspond to the XYZ axes with regard to the cartridge 4 in the mounted state.

Figure 6:
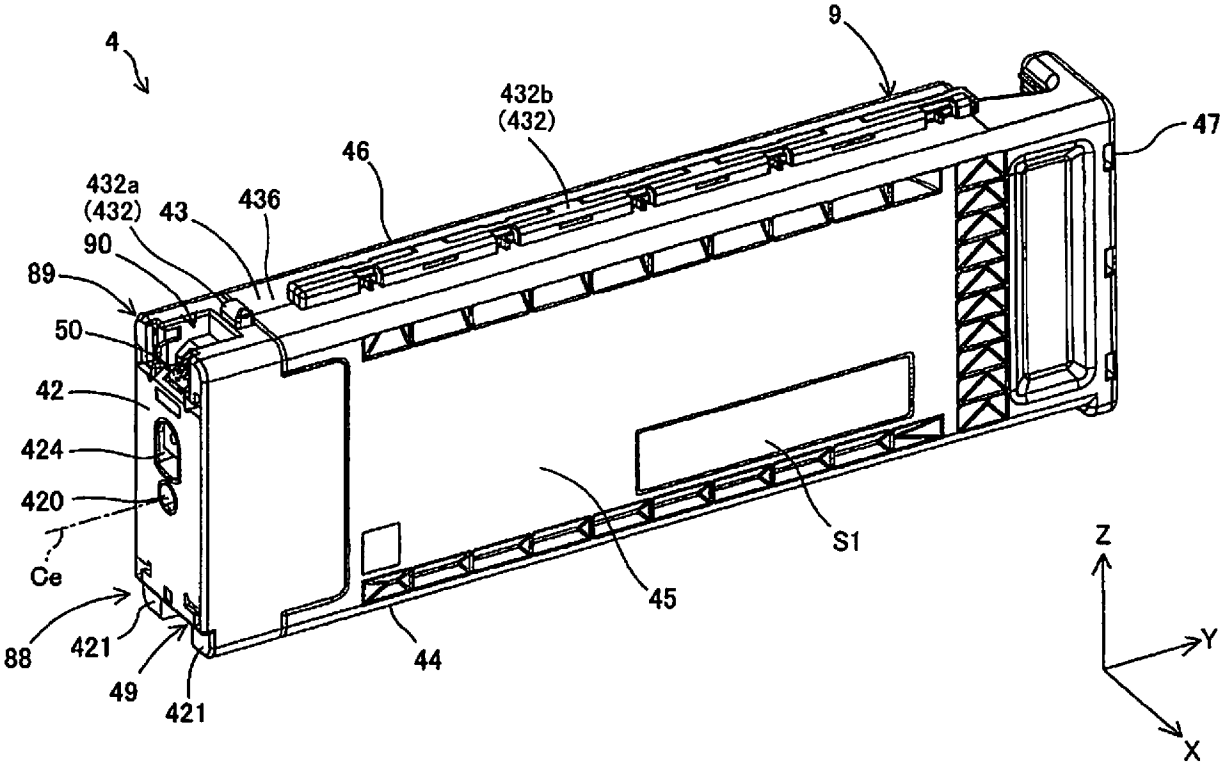
FIG. 6 is a first perspective diagram of the external appearance of a cartridge 4.
Figure 7:
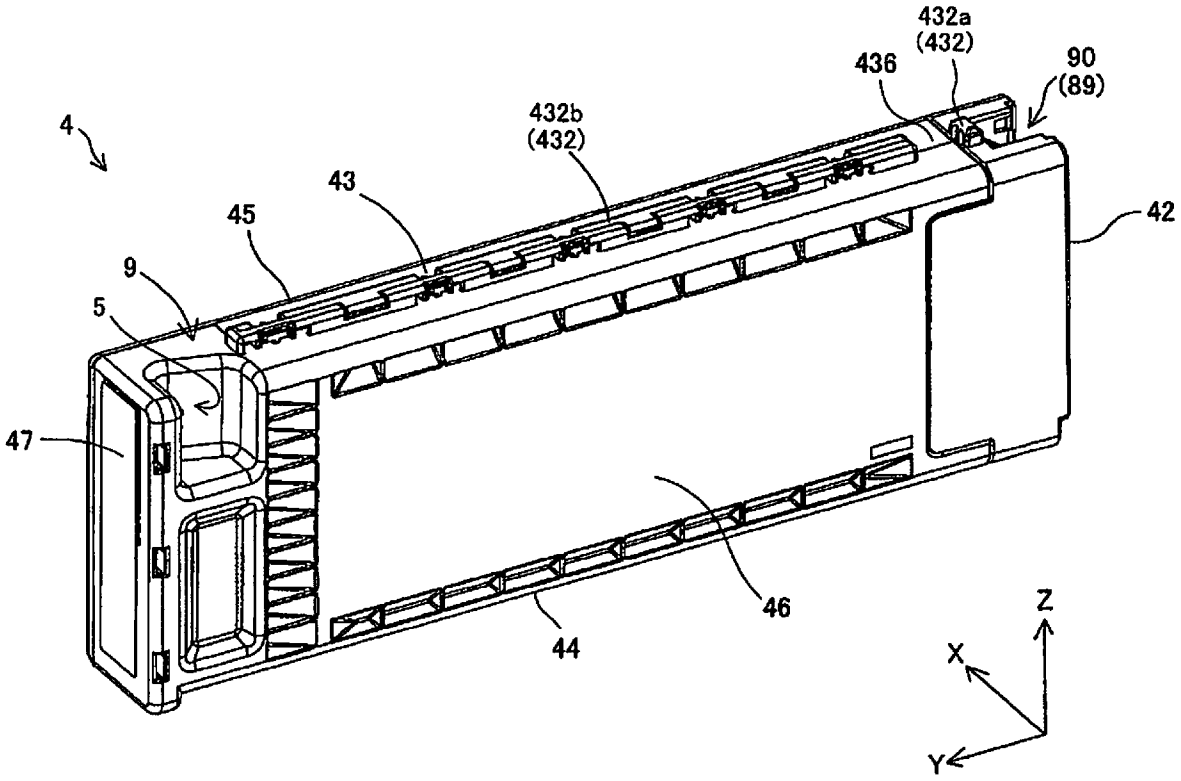
FIG. 7 is a second perspective diagram of the external appearance of the cartridge 4.
Figure 8:
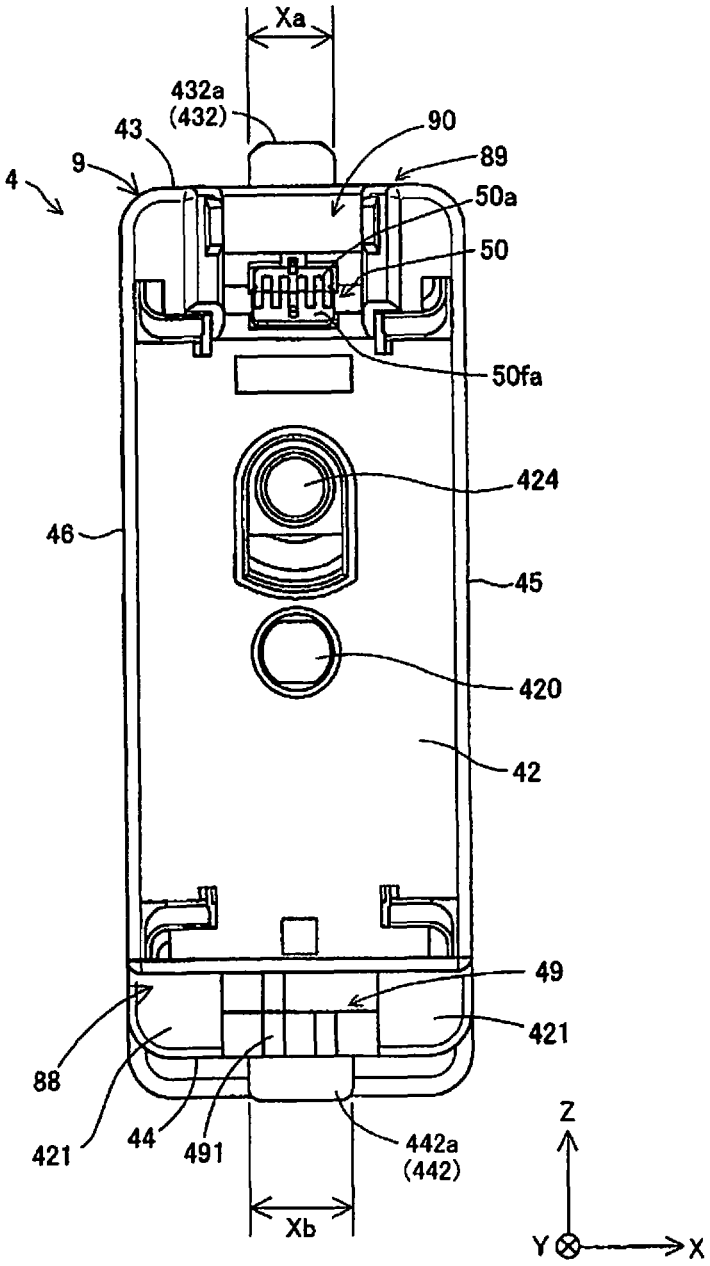
FIG. 8 is a front surface diagram of the cartridge 4.
Figure 9:
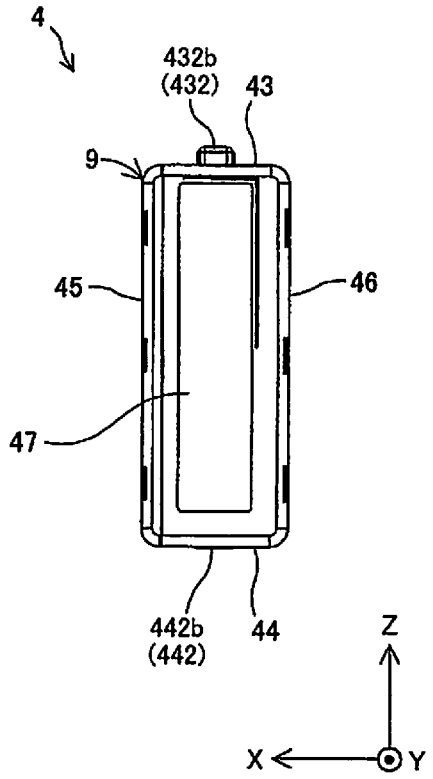
FIG. 9 is a rear surface diagram of the cartridge 4.
Figure 10:
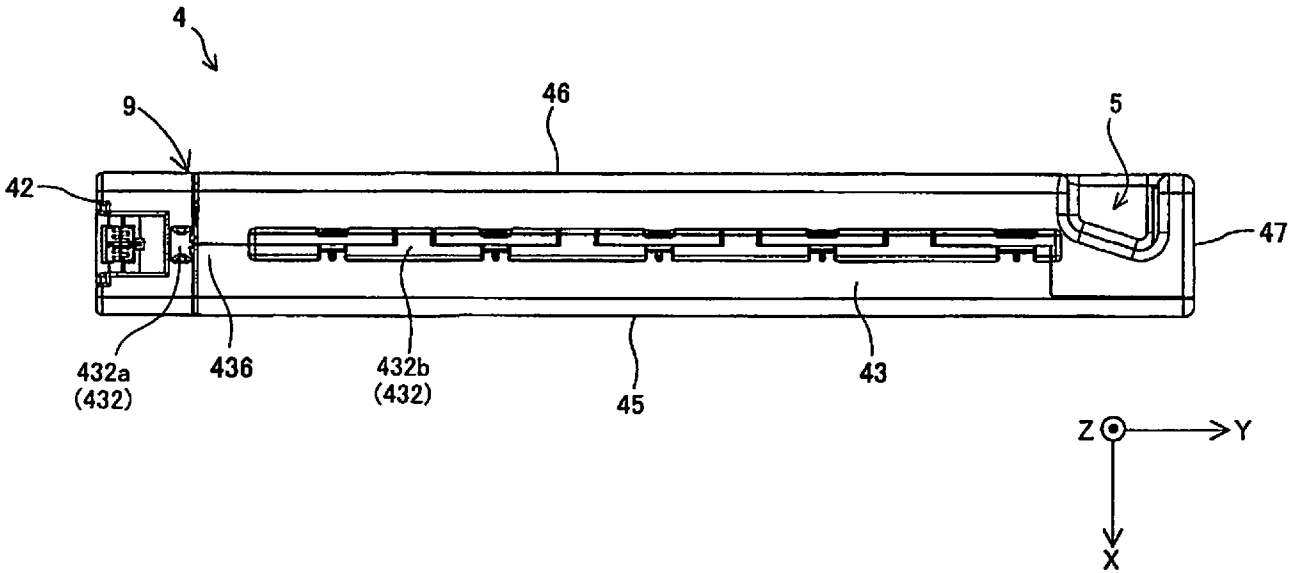
FIG. 10 is an upper surface diagram of the cartridge 4.
Figure 11:
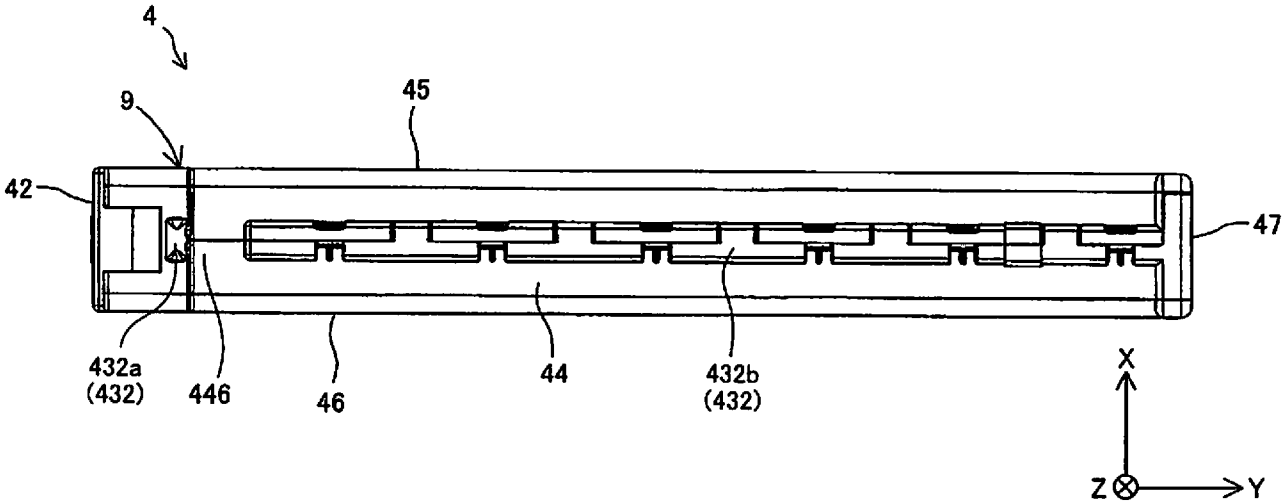
FIG. 11 is a lower diagram of the cartridge 4.
Figure 12:
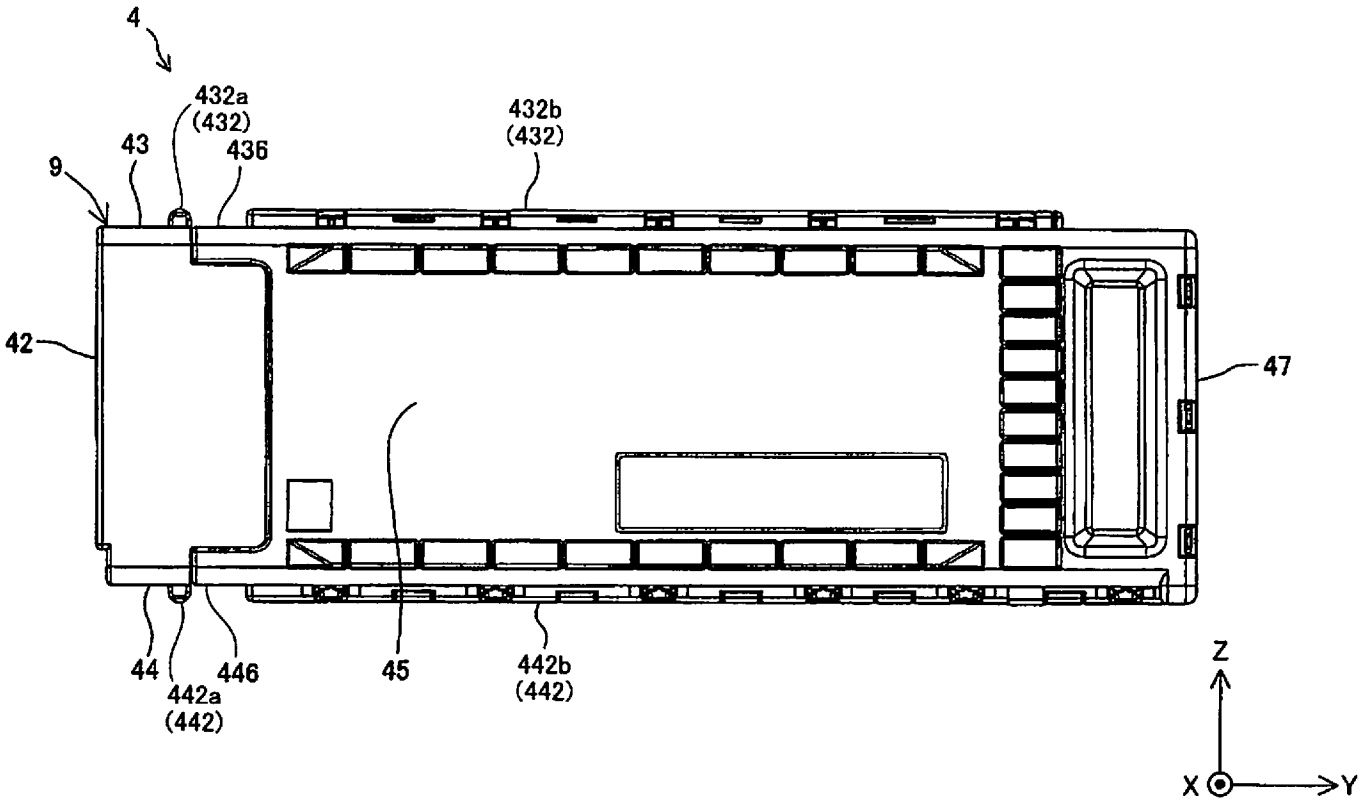
FIG. 12 is a first side surface diagram of the cartridge 4.
Figure 13:
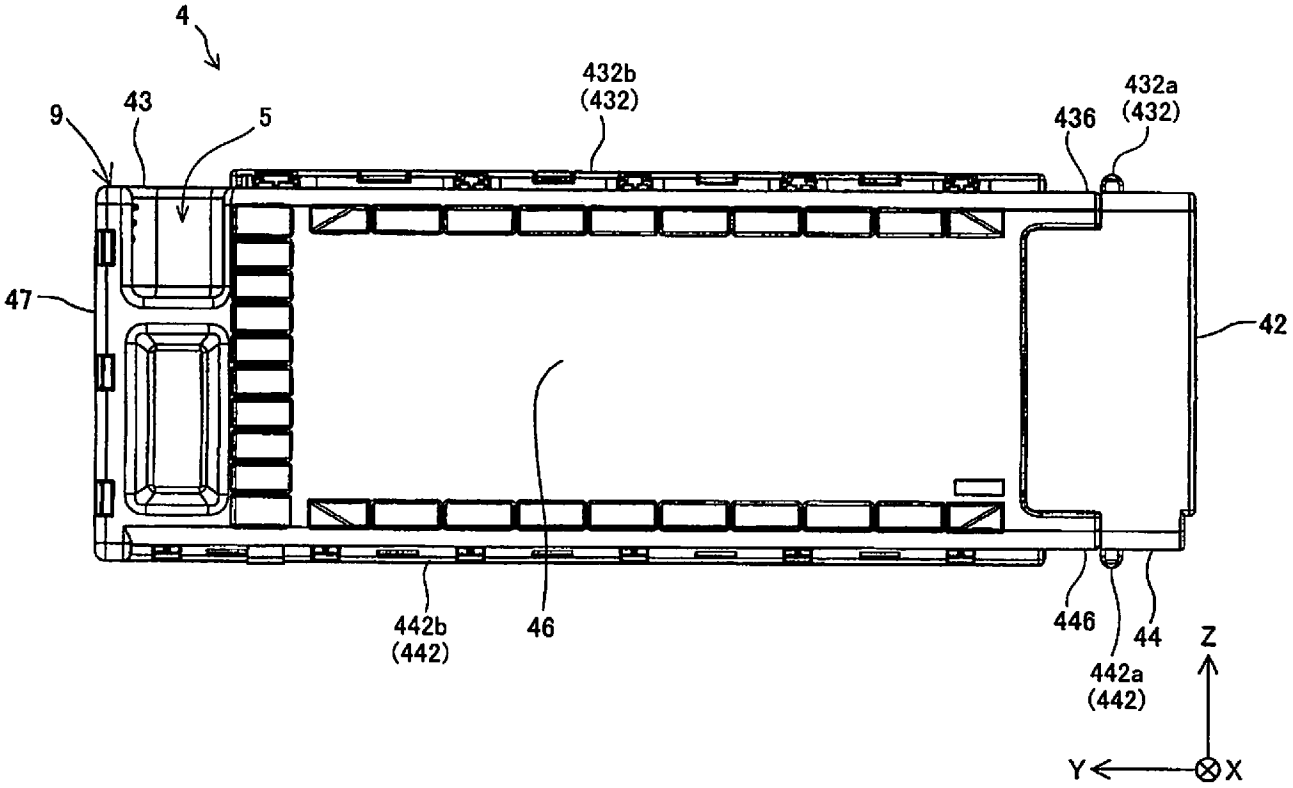
FIG. 13 is a second side surface diagram of the cartridge 4.

FIG. 6 is a first perspective diagram of the external appearance of the cartridge 4. FIG. 7 is a second perspective diagram of the external appearance of the cartridge 4. FIG. 8 is a front surface diagram of the cartridge 4. FIG. 9 is a rear surface diagram of the cartridge 4. FIG. 10 is an upper surface diagram of the cartridge 4. FIG. 11 is a lower surface diagram of the cartridge 4. FIG. 12 is a first side surface diagram of the cartridge 4. FIG. 13 is a second side surface diagram of the cartridge 4.

As shown in FIG. 6 and FIG. 7, the outer shape of the cartridge 4 is a substantially rectangular shape. The dimensions of the cartridge 4 become smaller in the order of the Y axis direction, the Z axis direction, and the X axis direction. The cartridge 4 is provided with a case 9 which contains the ink in an inner portion. The case 9 is a housing which is formed by molding a synthetic resin. The cartridge 4 is provided with a front surface 42, a rear surface 47, a first side surface 43 (an upper surface), a second side surface (a lower surface) 44, a third side surface 45 (a right surface), and a fourth side surface 46 (a left surface).

The first side surface 43 is also referred to as the upper surface 43, the second side surface 44 is also referred to as the bottom surface 44, the third side surface 45 is also referred to as the right side surface 45, and the fourth side surface 46 is also referred to as the left side surface 46. The front surface 42 and the rear surface 47 are opposed in the Y axis direction, and the front surface 42 is positioned at the −Y axis direction side and the rear surface 47 is positioned at the +Y axis direction side. The first side surface 43 and the second side surface 44 intersect with the front surface 42 and the rear surface 47 and are opposed in the Z axis direction. The first side surface 43 is positioned at the +Z axis direction side and the second side surface 44 is positioned at the −Z axis direction side. The third side surface 45 and the fourth side surface 46 intersect with the front surface 42, the rear surface 47, the first side surface 43, and the second side surface 44 and are opposed in the X axis direction. The third side surface 45 is positioned at the +X axis direction side and the fourth side surface 46 is positioned at the −X axis direction side.

The shape of the front surface 42 is a substantially rectangular shape where the dimension in the Z axis direction is larger than the dimension in the X axis direction. The front surface 42 and the apparatus side front wall section 62 (FIG. 4) face each other in the mounted state.

A rod insertion hole 420 and a supply pipe insertion hole 424 are formed in the front surface 42. The rod insertion hole 420 is provided in the front surface 42 at an intermediate position between the first side surface 43 and the second side surface 44. In other words, the rod insertion hole 420 is provided at an intermediate position in the Z axis direction which joins the first side surface 43 and the second side surface 44. That is, a central axis Ce of the rod insertion hole 420 is arranged at an intermediate position of the first side surface 43 and the second side surface 44 in the Z axis direction. Here, it is not necessary for the "intermediate position" to be exactly in the middle, and it is sufficient if the first and second side surfaces 43 and 44 are not arranged to be for there to be deviation. For example, the "intermediate position" includes positions which are within a range of less than 10% from the central position with regard to the distance with the first side surface 43 and the second side surface 44 in the Z axis direction.

Out of the sites where the first side surface 43 and the fourth side surface 46 intersect, a handle section 5 (a concave section), which has a concave shape in order for the operator to insert a finger when attaching and detaching the cartridge 4, is formed at a site in the vicinity of the rear surface 47.

In the mounted state, a printing material supply pipe 642 (FIG. 4) is inserted into the supply pipe insertion hole 424. In addition, a printing material discharge pipe 484 (FIG. 4) for circulating the ink inside the cartridge 4 to the outside is arranged inside the supply pipe insertion hole 424. By connecting the printing material supply pipe 642 to the printing material discharge pipe 484, it is possible to circulate the ink inside the cartridge 4 to the printing material supply pipe 642.

In the mounted state, the rod 662 (FIG. 4), in which a portion of the outer circumference is covered by a rod cover 720, is inserted into the rod insertion hole 420. By the rod 662 being inserted into the rod insertion hole 420, the position alignment of the entire cartridge 4 is performed with regard to the cartridge mounting section 6 and position deviation from the correct mounting position is suppressed. In addition, in the mounted state, the rod 662 abuts against a lever member 490 (FIG. 4).

As shown in FIG. 6, FIG. 10, FIG. 12 and FIG. 13, the first side surface 43 has a first convex section 432. The first convex section 432 protrudes to the +Z axis direction side from the first side surface 43. The first convex section 432 extends along the Y axis direction. In detail, as shown in FIG. 12 and FIG. 13, the first convex section 432 extends from a position in the vicinity of the front surface 42 up to a position in the vicinity of the rear surface 47 in the first side surface 43 and is divided into a first section 432*a* of the −Y axis direction side and a second section 432*b* of the +Y axis direction side with a first locking section 436 which has a concave shape formed therebetween.

As shown in FIG. 11 to FIG. 13, the second side surface 44 has a second convex section 442. The second convex section 442 protrudes from the second side surface 44 to the −Z axis direction side. The second convex section 442 extends along the Y axis direction. In detail, as shown in FIG. 12 and FIG. 13, the second convex section 442 extends from a position in the vicinity of the front surface 42 up to a position in the vicinity of the rear surface 47 in the first side surface 43, and is divided into a first section 442*a* of the −Y axis direction side and a second section 442*b* of the +Y axis direction side with a second locking section 446 which has a concave shape formed therebetween. When the cartridge 4 is mounted in the cartridge mounting section 6, the first convex section 432 is inserted into the first rail 682 (FIG. 5) and the second convex section 442 is inserted into the second rail 602 (FIG. 4). Due to this, it is possible to smoothly push the cartridge 4 forward with regard to the corresponding slot of the cartridge mounting section 6.

As shown in FIG. 8, a dimension (width) Xa of the first convex section 432 in the X axis direction and a dimension (width) Xb of the second convex section 442 in the X axis direction are different. A relationship where the dimension Xa<dimension Xb is satisfied. In addition, the dimension of the second convex section 442 in the X axis direction is larger than the first rail 682 (FIG. 5) and it is not possible to insert the second convex section 442 into the first rail 682. Due to this, it is possible to reduce the possibility that the cartridge 4 will be mounted in cartridge mounting section 6 in a state where the orientation of the first side surface 43 and the second side surface 44 is reversed by mistake. In addition, in the mounted state, the leaf spring 684 (FIG. 5) is placed into the first locking section 436 and the leaf spring 604 (FIG. 4) is placed into the second locking section 446. Due to this, the cartridge 4 is prevented from being inadvertently detached from the cartridge mounting section 6.

As shown in FIG. 6, a label S1 is attached to the third side surface 45. Information (such as matters which require attention regarding the use) which relates to the handling of the cartridge 4 is written in the label S1.

As shown in FIG. 8, a concave section 49 and a pair of regulating surfaces 421 are provided in a corner section 88 where the front surface 42 and the second side surface 44 intersect. Cartridge side identification members 491 are provided in the concave section 49. The cartridge side identification members 491 are formed by one or more ribs and formed in shapes which are different according to the colors of the inks to be contained. In addition, the cartridge side identification member 491 is engaged with the apparatus side identification member 610 (FIG. 4) by being mounted in the correct slot of the cartridge mounting section 6. The pair of regulating surfaces 421 is arranged at both sides of the concave section 49 in the X axis direction. The pair of regulating surfaces 421 abuts against the regulating member 612 (FIG. 4) when the cartridge 4 reaches up to the correct mounting position.

Figure 15:
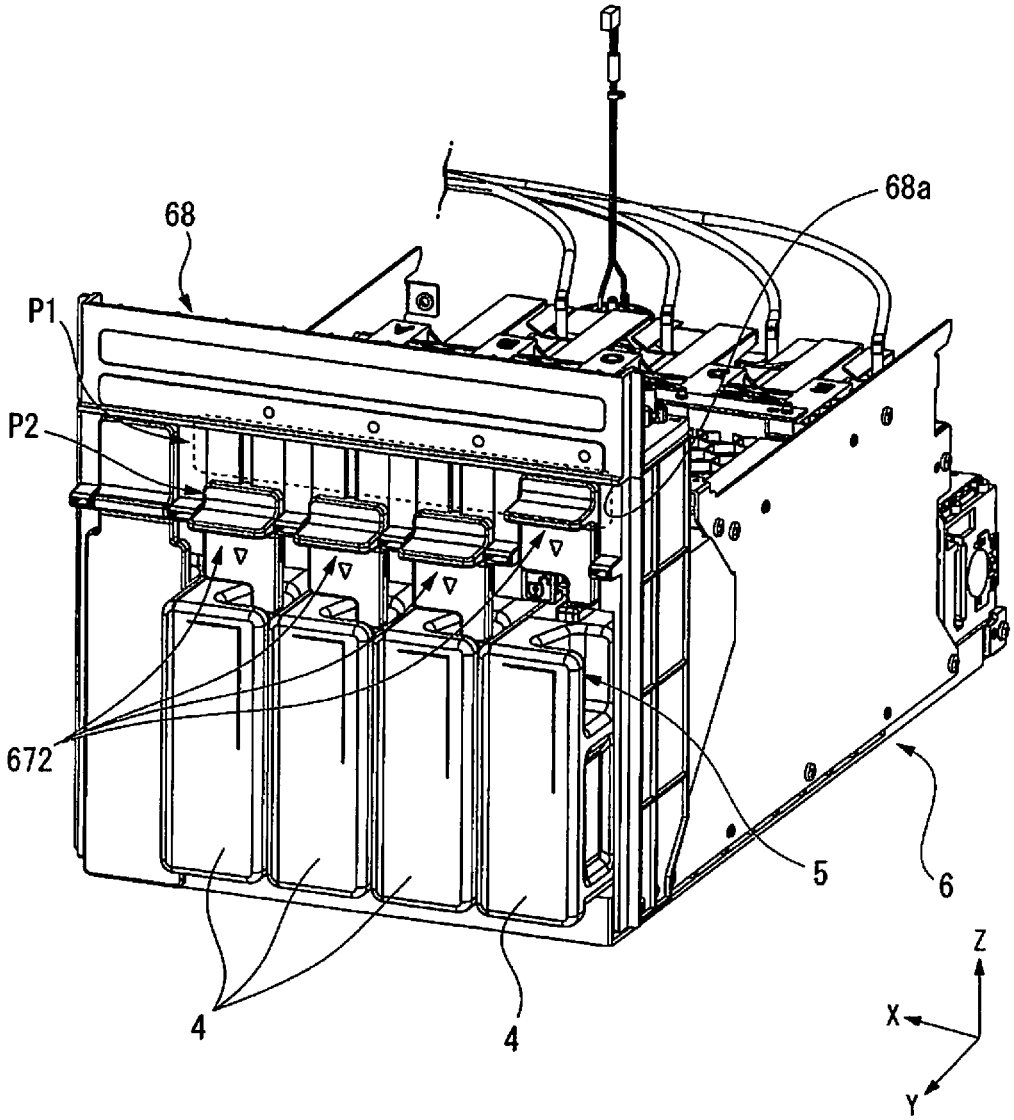
FIG. 15 is a perspective diagram of the external appearance illustrating the cartridge mounting section 6 in the cartridge mounting state.

As shown in FIG. 6 and FIG. 8, the cartridge 4 is further provided with a concave section 90 which is provided in a corner section 89 where the front surface 42 and the first side surface 43 are orthogonal. In other words, the concave section 90 is provided to span across the front surface 42 and the first side surface 43. A circuit board 50 is arranged in the concave section 90. A cartridge side terminal group 521 is formed on a surface 50*fa* (FIG. 8) of the circuit board 50. The cartridge side terminal group 521 is provided with a plurality of terminals (nine). In the mounted state, each of the terminals of the cartridge side terminal group 521 is electrically connected by coming into contact with each of the terminals which correspond to the apparatus side terminal group 721 (FIG. 15).

Figure 14:
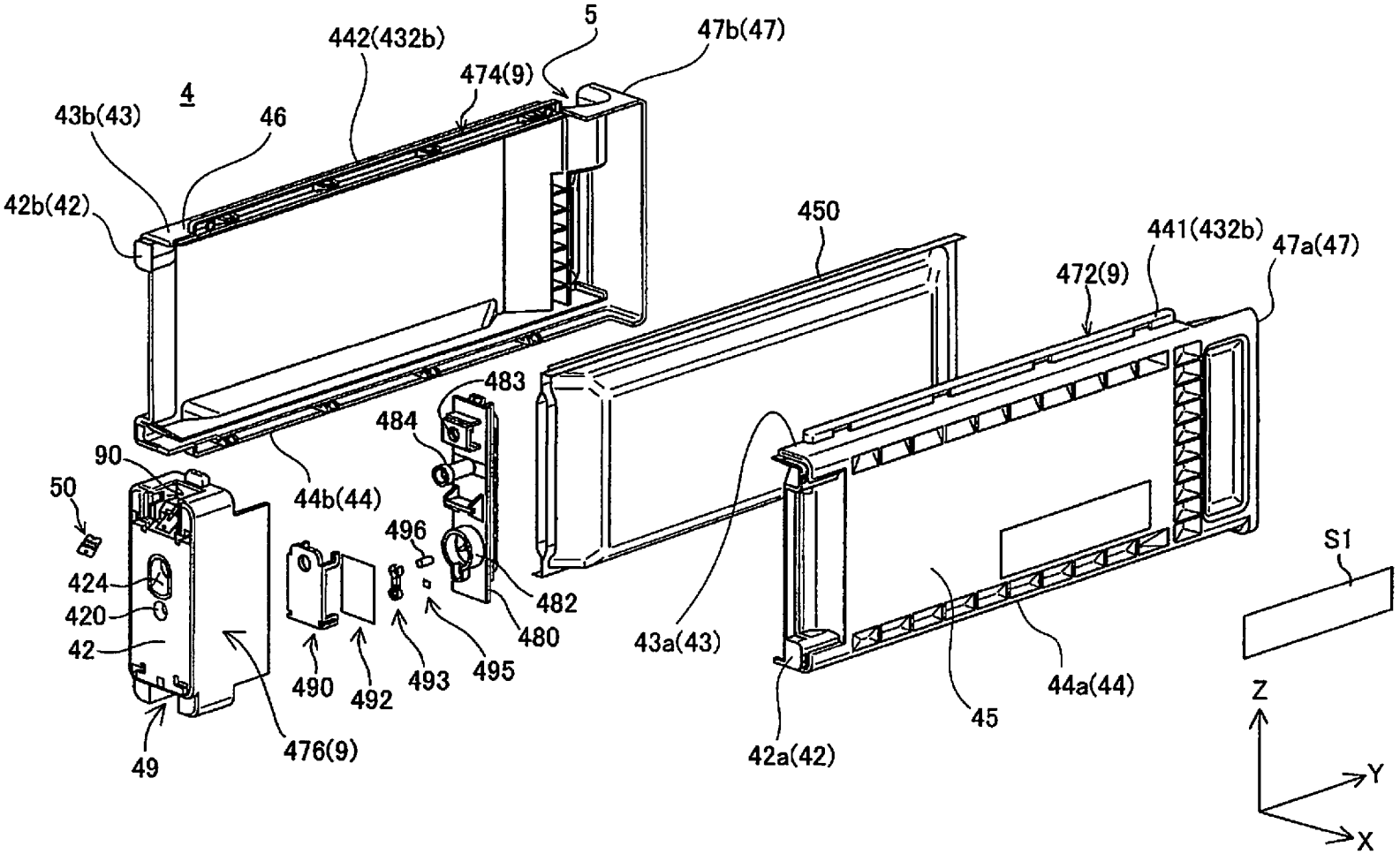
FIG. 14 is an exploded perspective diagram of the cartridge 4.

FIG. 14 is an exploded perspective diagram of the cartridge 4.

As shown in FIG. 14, the case 9 contains a printing material containing section 450 and a cartridge side flow path member 480. The printing material containing section 450 contains the ink in an inner portion. In addition, the printing material containing section 450 is a bag which has flexibility. The printing material containing section 450 is formed by an aluminum laminate multilayer film where aluminum layers are laminated on a resin film layer.

The cartridge side flow path member 480 forms a flow path (also referred to as a "printing material discharge flow path") which links the printing material containing section 450 and the outside. That is, one end portion of the cartridge side flow path member 480 is connected to the inside of the printing material containing section 450 and the printing material discharge pipe 484 which is provided in the other end portion is connected to the printing material supply pipe 642 (FIG. 4). A detection chamber 482 is provided in the middle of the printing material discharge flow path.

A coil spring 496 which is a pressing member, a check valve 495, and a pressure receiving plate 493 are contained inside the detection chamber 482. In addition, the opening which is one side surface of the detection chamber 482 is covered by a film 492 which has flexibility. The pressure receiving plate 493 is arranged between the coil spring 496 and the film 492. The coil spring 496 presses the pressure receiving plate 493 such that the volume of the detection chamber 482 is increased.

The case 9 further contains the lever member 490. The lever member 490 is contact with the film 492 from the outside of the detection chamber 482. The volume of the detection chamber 482 changes according to changes in the pressure of the inner portion. The lever member 490 is displaced by changes in the volume of the detection chamber 482. As described above, the rod 662 (FIG. 4) abuts against the lever member 490. In a case where the inside of the printing material containing section 450 is suctioned by the pump mechanism 7 in a state where the ink is contained in the printing material containing section 450, the ink is also supplied to the inside of the detection chamber 482 in accompaniment with the suction. Due to this, the pressure inside the detection chamber 482 is maintained at a predetermined pressure. At this time, since the volume of the detection chamber 482 is maintained to be high, the rod 662 (FIG. 4) enters a state of being pressed in the −Y axis direction by the lever member 490 against the pressing force which is applied by a pressing member 665 (FIG. 4).

On the other hand, in a case where the inside of the printing material containing section 450 is suctioned by the pump mechanism 7 in a state where the ink has run out in the printing material containing section 450, there is a negative pressure in the inside of the detection chamber 482. The volume of the inside of the detection chamber 482 is reduced to less than when it is a predetermined pressure by the inside of the detection chamber 482 being a negative pressure, and the lever member 490 is displaced. In accompaniment with this, the rod 662 (FIG. 4) is displaced in the +Y axis direction by the pressing force which is applied by the pressing member 665 (FIG. 4). It is possible for the control section 31 to detect the state where the ink has run out using a sensor 138 (FIG. 4) detecting the displacement of the rod 662 (FIG. 4) which accompanies the displacement of the lever member 490.

The detection chamber 482, the coil spring 496, the pressure receiving plate 493, the film 492, and the lever member 490 configure a detection mechanism which is used in order to detect the state where the ink has run out at the printer 10 side.

The cartridge side flow path member 480 further has an injection flow path 483 for injecting the ink from the outside into the printing material containing section 450. After the ink is injected into the printing material containing section 450, the injection flow path 483 is closed off.

FIG. 15 is a perspective diagram of the external appearance illustrating the cartridge mounting section 6 in the mounting state.

Figure 16:
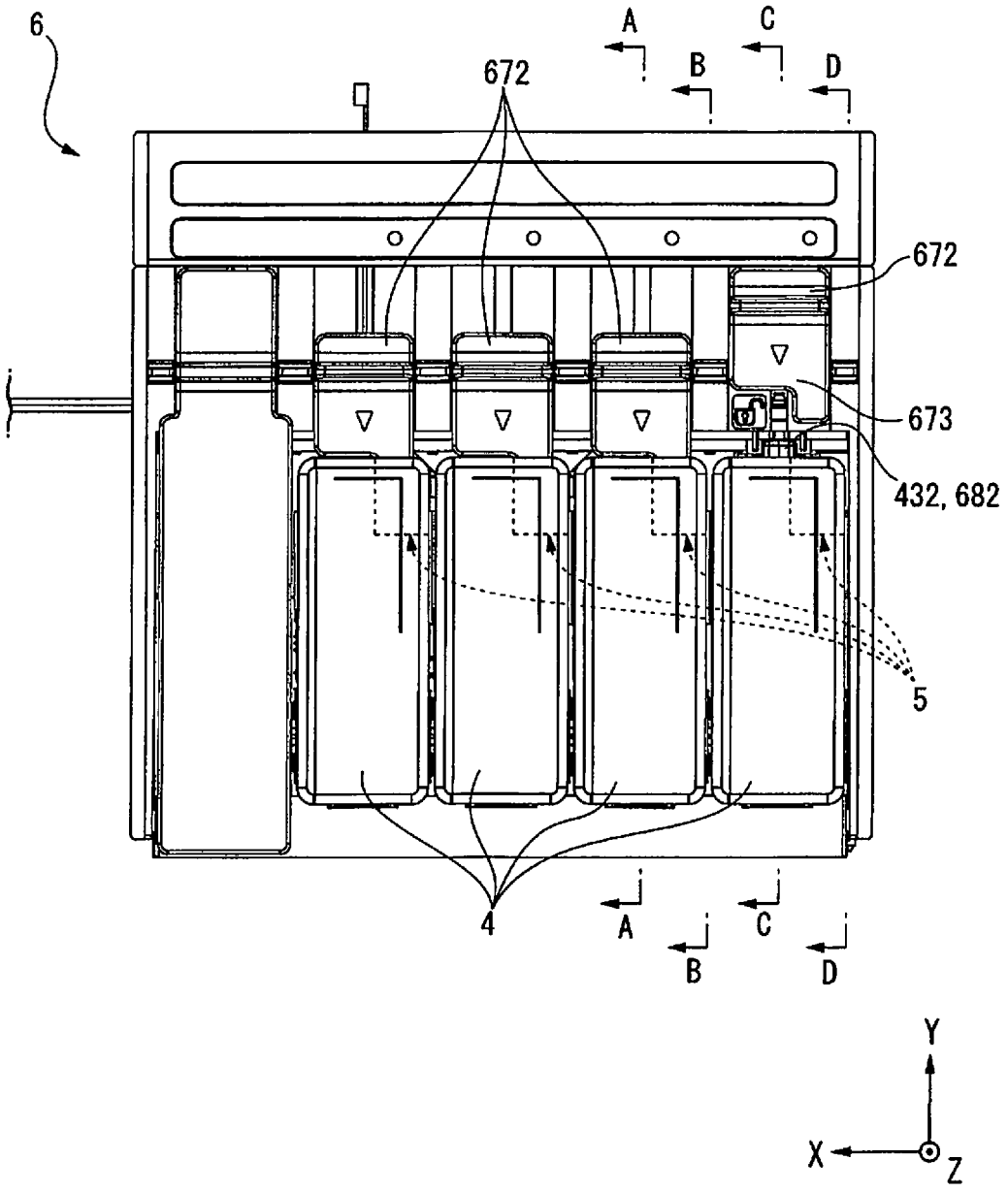
FIG. 16 is a front surface diagram illustrating the cartridge mounting section 6 in the cartridge mounting state.

FIG. 16 is a front surface diagram illustrating the cartridge mounting section 6 in the mounting state.

FIG. 15 and FIG. 16 show a state where four of the cartridges 4 are mounted in each of the slots of the cartridge mounting section 6. A portion (the surfaces of the +Z axis direction side, the +X axis direction side, and the −X axis direction side) of the insertion opening 69 (refer to FIG. 2 and FIG. 3) of the cartridge mounting section 6 is surrounded by a frame section 68. Out of the four slots, in one slot of the −X axis direction side, the lever 672 is pressed up to a first position P1 which abuts against a ceiling portion 68*a* of the frame section 68. In addition, in the three slots other than the above one slot, the lever 672 is pushed down to a second position P2. In this manner, the lever 672 is provided so as to be able to move between the first position P1 and the second position P2.

Figure 17:
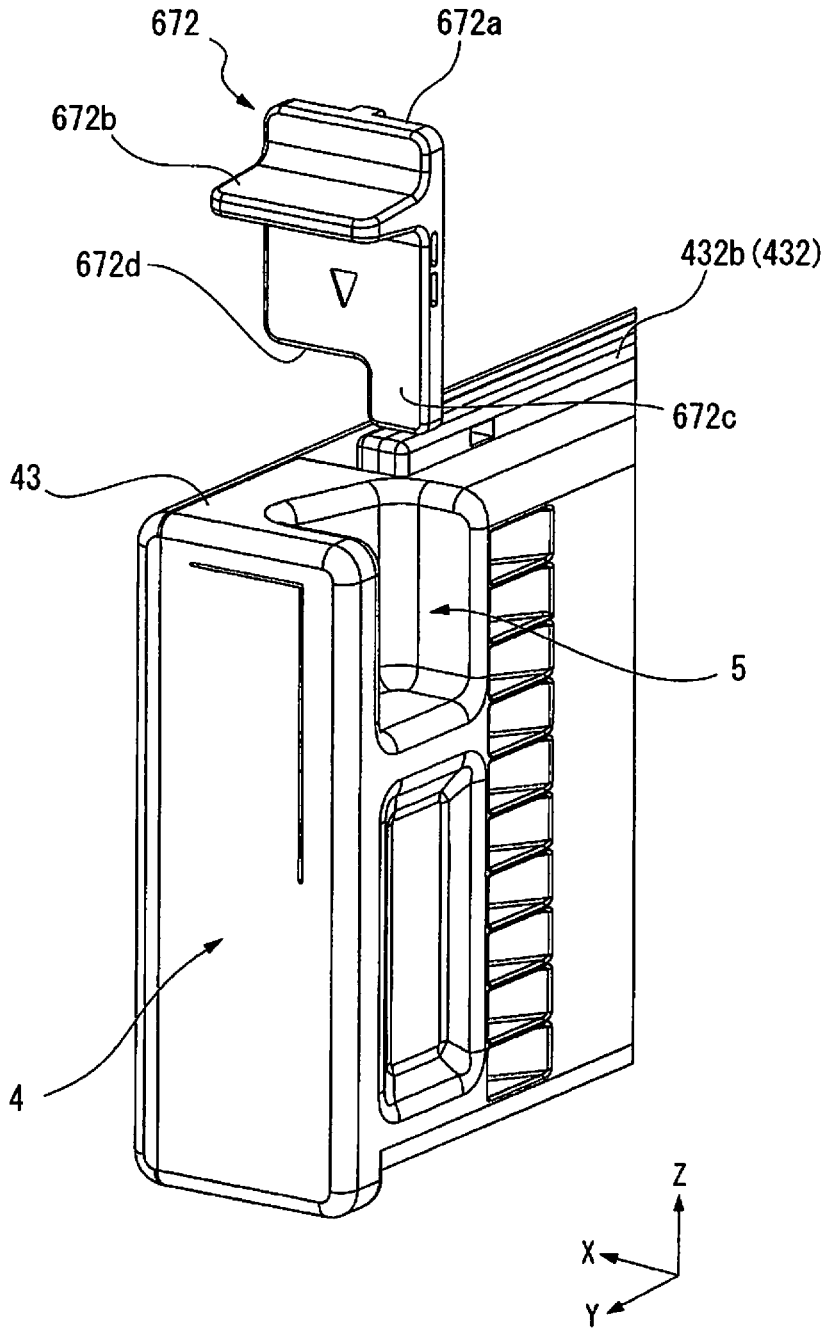
FIG. 17 is a perspective diagram of the external appearance illustrating the cartridge 4 and a lever 672.
Figure 18:
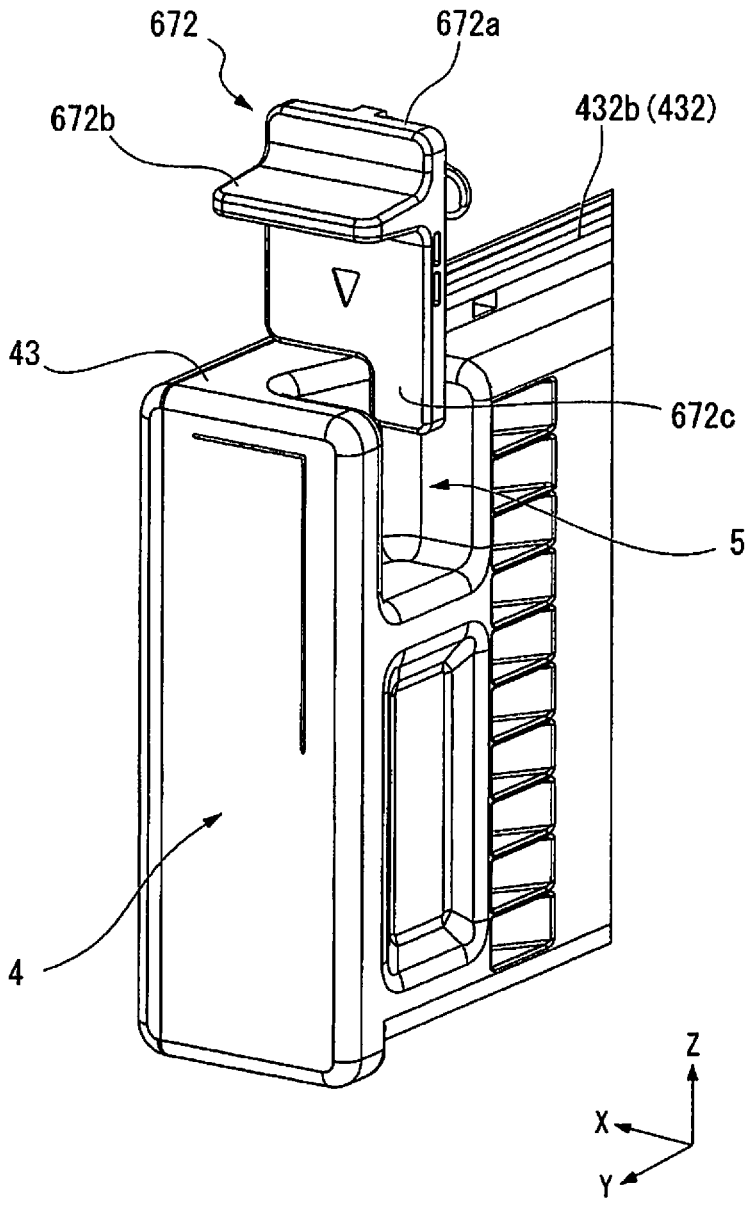
FIG. 18 is a perspective diagram of the external appearance illustrating the cartridge 4 and the lever 672.
Figure 19:
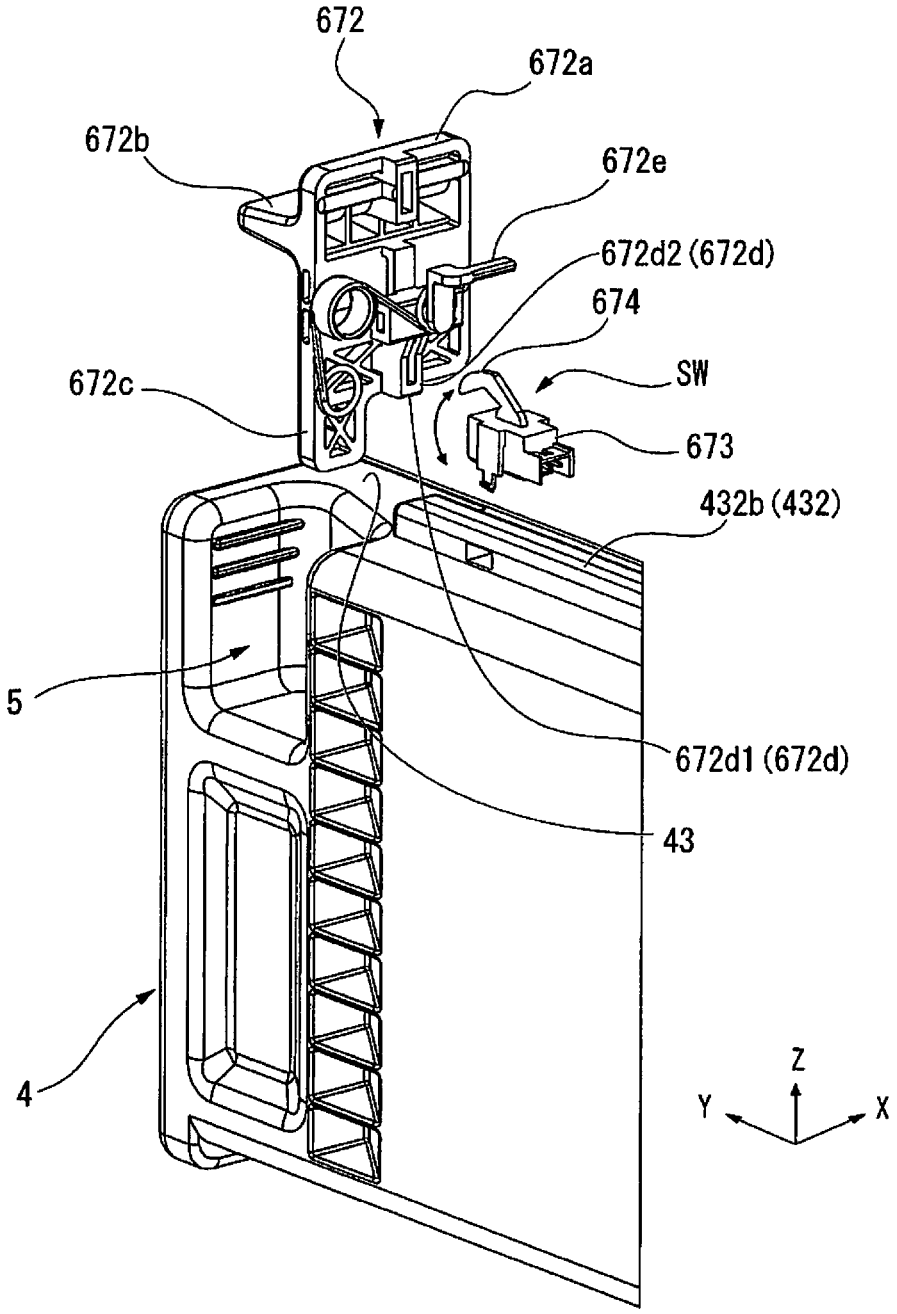
FIG. 19 is a perspective diagram of the external appearance illustrating the cartridge 4 and the lever 672.
Figure 20:
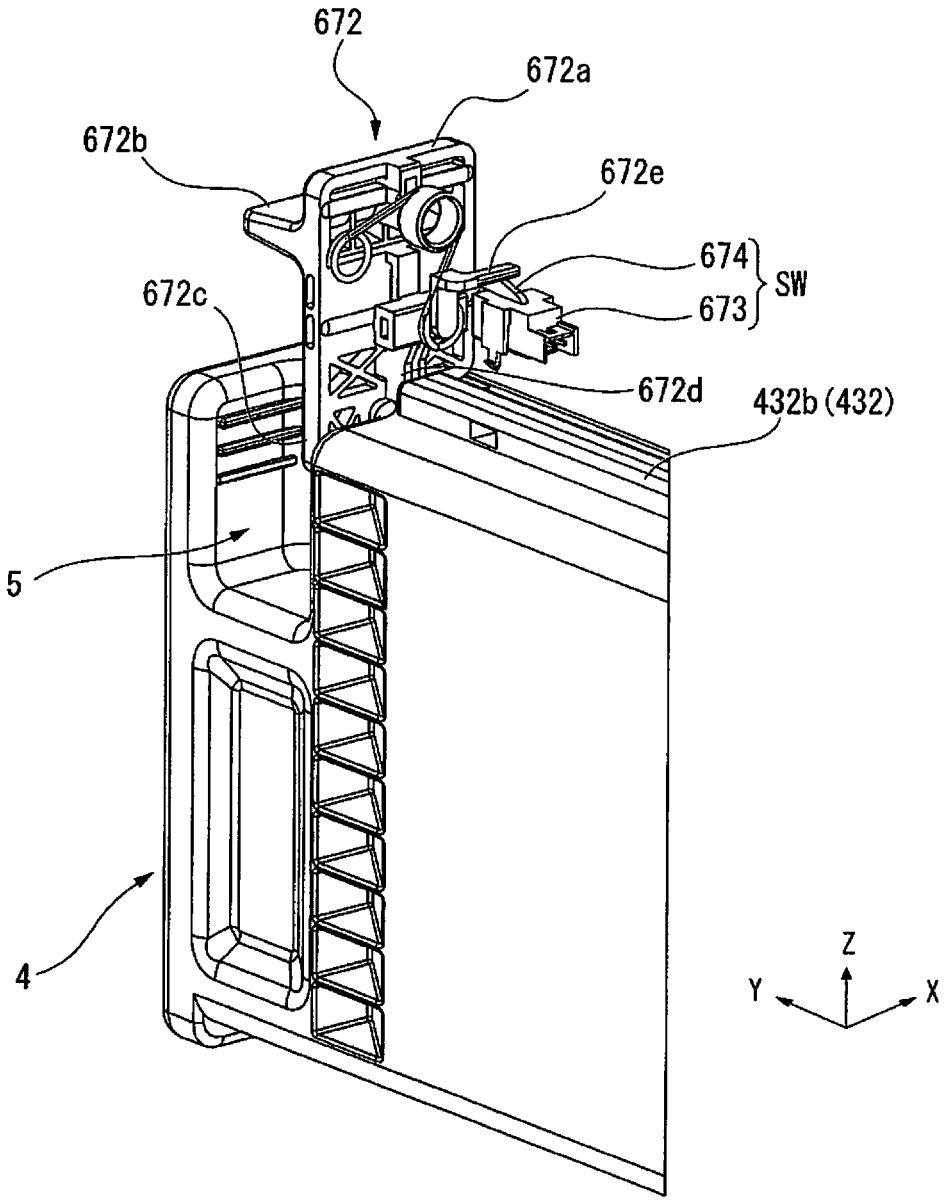
FIG. 20 is a perspective diagram of the external appearance illustrating the cartridge 4 and the lever 672.
Figure 21:
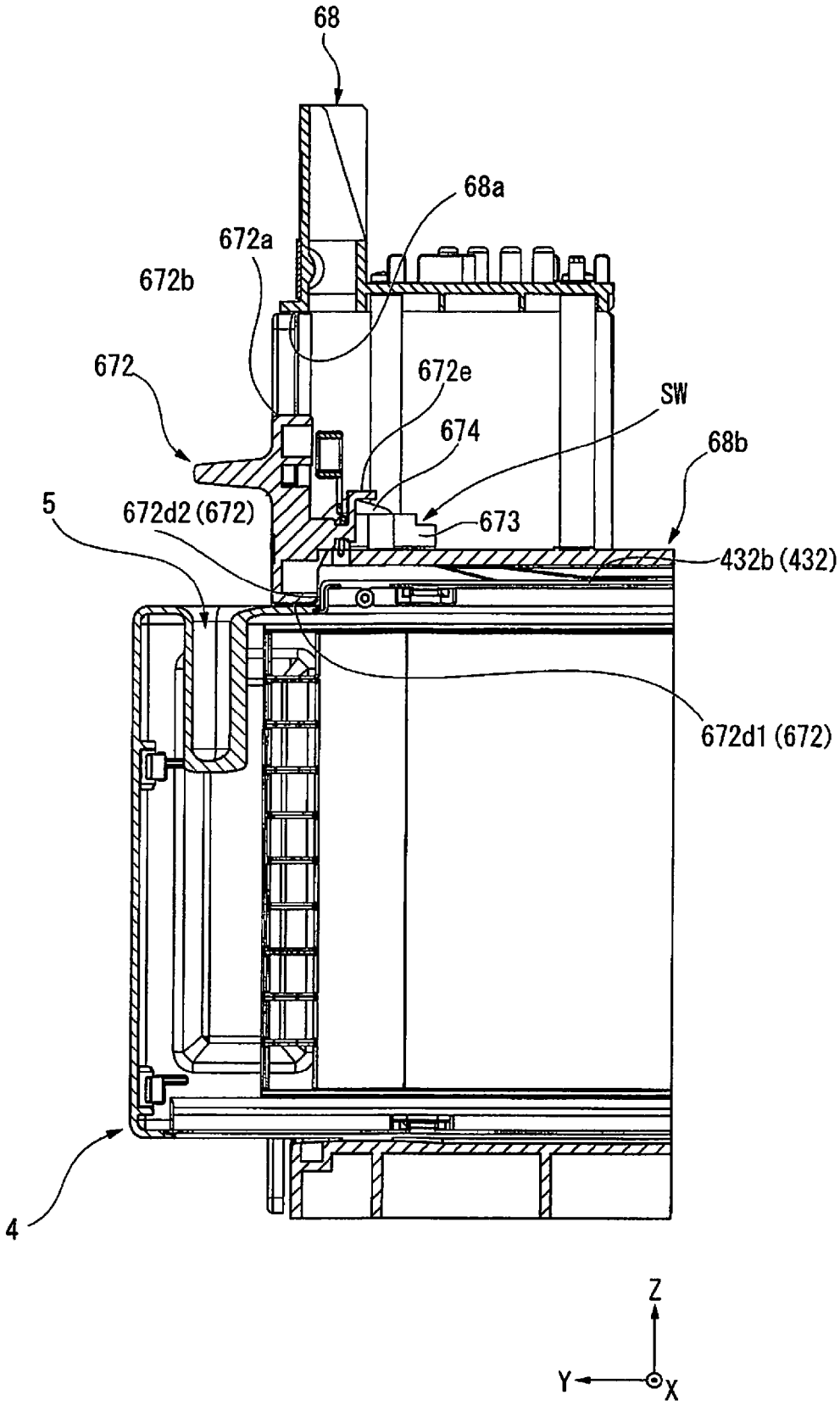
FIG. 21 is a cross sectional diagram illustrating the cartridge mounting section 6 and the lever 672.
Figure 22:
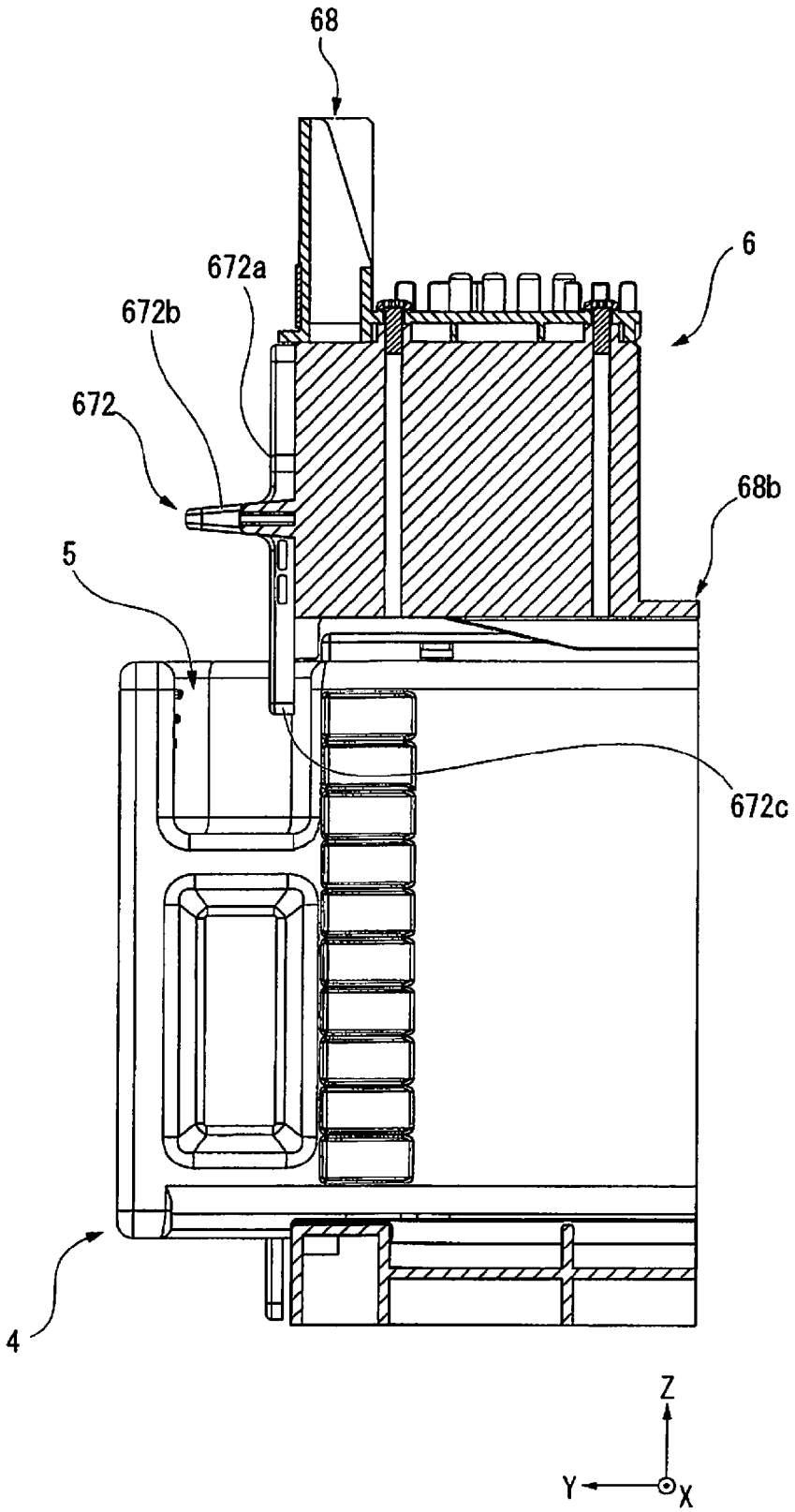
FIG. 22 is a cross sectional diagram illustrating the cartridge mounting section 6 and the lever 672.
Figure 23:
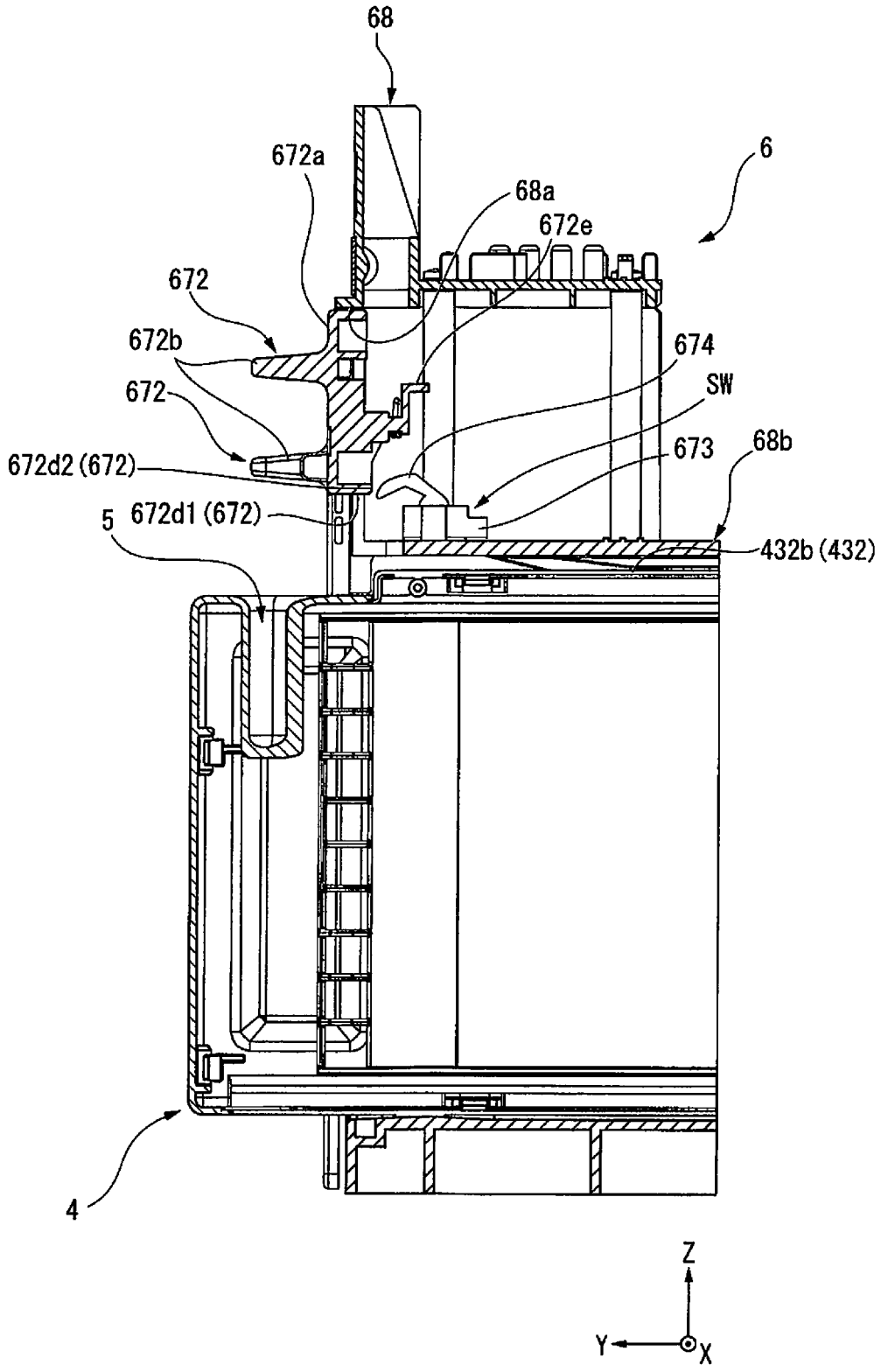
FIG. 23 is a cross sectional diagram illustrating the cartridge mounting section 6 and the lever 672.
Figure 24:
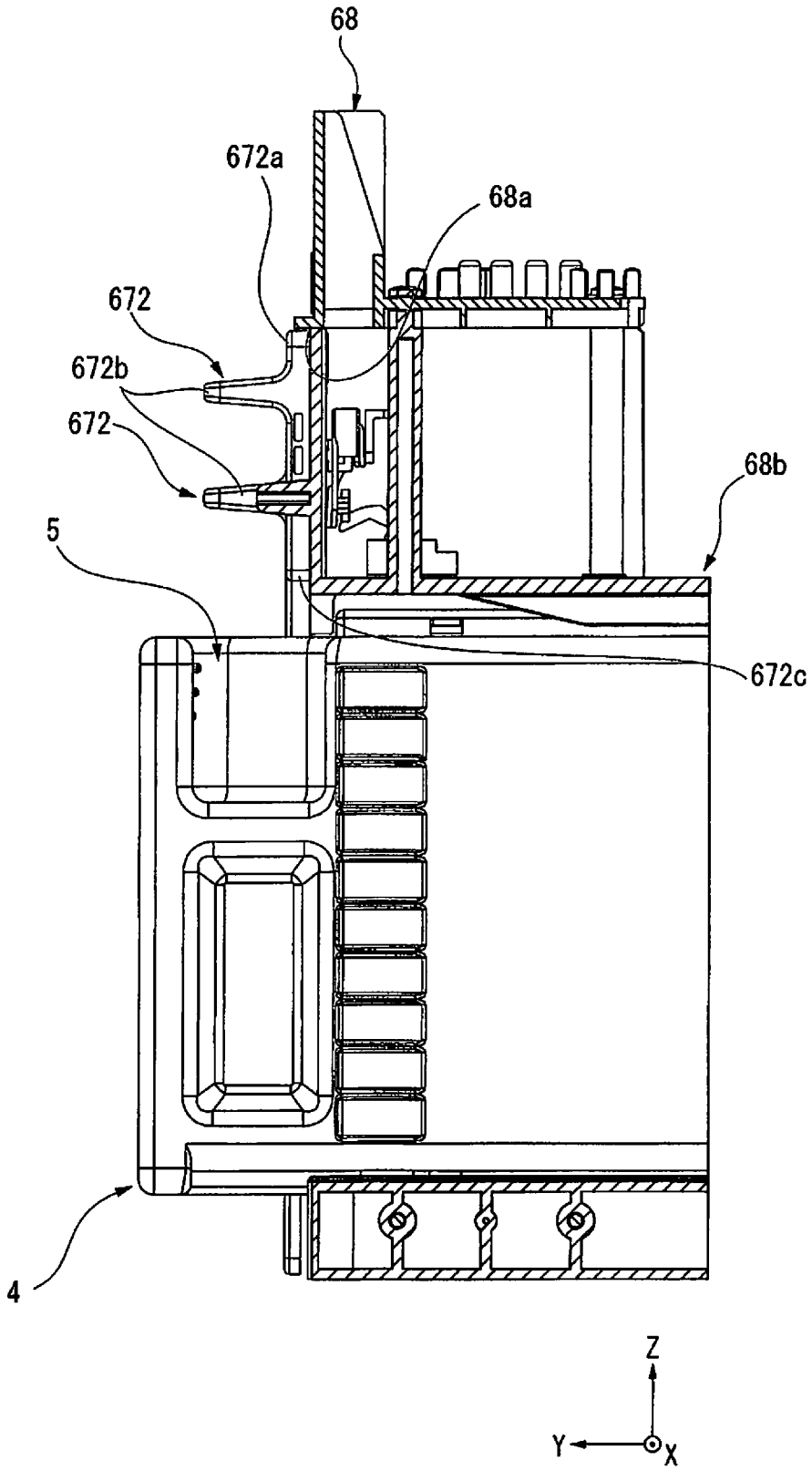
FIG. 24 is a cross sectional diagram illustrating the cartridge mounting section 6 and the lever 672.

FIG. 17 to FIG. 20 are perspective diagrams of the external appearance illustrating the configuration of the cartridge 4 and the lever 672. FIG. 17 and FIG. 18 show the configuration when the cartridge mounting section 6 is viewed from the front surface side. FIG. 19 and FIG. 20 show the configuration when the cartridge mounting section 6 is viewed from the rear surface side. FIG. 17 and FIG. 19 show a state where the lever 672 is arranged at the first position P1. FIG. 18 and FIG. 20 show a state where the lever 672 is arranged at the second position P2. FIG. 17 to FIG. 20 omit the illustration of a portion of the configuration in the cartridge 4 and the cartridge mounting section 6. In addition, FIG. 21 is a cross sectional diagram of A-A in FIG. 16. FIG. 22 is a cross sectional diagram of B-B in FIG. 16. FIG. 23 is a cross sectional diagram of C-C in FIG. 16. FIG. 24 is a cross sectional diagram of D-D in FIG. 16. FIG. 18, FIG. 20, FIG. 21, and FIG. 22 show a state where the lever 672 is pushed down. FIG. 17, FIG. 19, FIG. 23, and FIG. 24 show a state where the lever 672 is pushed up.

As shown in FIG. 17 to FIG. 20, the lever 672 has a body section 672*a*, a gripping portion 672*b*, a regulating section 672*c*, a first abutting section 672*d*1, a second abutting section 672*d*2, and a switch changing section 672*e*.

The body section 672*a* is formed in, for example, a rectangular plate shape. The body section 672*a* is provided so as to be able to move in the Z axis direction using a slide mechanism which is not shown in the diagram. The gripping portion 672*b* is formed so as to protrude to the +Y axis direction side from the surface (the surface of the +Y axis direction side) of the body section 672*a*. The gripping portion 672*b* is a portion for gripping when the user moves the lever 672.

The regulating section 672*c* is formed so as to protrude to the −Z axis direction side from the body section 672*a*. The regulating section 672*c* is inserted into the handle section 5 of the cartridge 4 in a state where the lever 672 is pushed down to the second position P2. The regulating section 672*c* is formed to have dimensions which are able to be contained in the handle section 5. As shown in FIG. 18, FIG. 20, and FIG. 22, in a state where the lever 672 is pushed down to the second position P2, locking is performed between the inner wall of the −Y axis direction side of the handle section 5 and the regulating section 672*c*. That is, the regulating section 672*c* which is inserted in the handle section 5 closes off the handle section 5, and due to this, the pulling out of the cartridge 4 by the user is regulated.

In addition, as shown in FIG. 17, FIG. 19, and FIG. 24, the regulating section 672*c* is formed so as not to be inserted into the handle section 5 in a state where the lever 672 is pushed up to the first position P1, that is, so as to be arranged at the outside (the +Z axis direction side of the handle section 5) of the handle section 5. In a state where the lever 672 is pushed up to the first position P1, the regulating section 672*c* releases the handle section 5, and due to this, there is a state where it is possible for the cartridge 4 to be pulled out by the user. Here, in a plan view of the upper surface 43 of the cartridge 4, the width of the handle section 5 is larger at the rear surface 47 side than at the front surface 42 side.

As shown in FIG. 19 and FIG. 20, an abutting section 672*d* is formed so as to protrude to the −Y axis direction side from the rear surface (the surface of the −Y axis direction side) of the body section 672*a*. As shown in FIG. 19, the abutting section 672*d* has the first abutting section 672*d*1 and the second abutting section 672*d*2. The first abutting section 672*d*1 is provided at the −Z axis direction side end portion of the abutting section 672*d*. As shown in FIG. 21, the first abutting section 672*d*1 abuts against the first side surface 43 of the cartridge 4 in a state where the lever 672 is pushed down to the second position P2. The movement of the lever 672 in the −Z axis direction is regulated by the first abutting section 672*d*1 abutting against the first side surface 43. In this manner, the first abutting section 672*d*1 functions as a stopper at the −Z axis direction side of the lever 672. In addition, as shown in FIG. 19 and FIG. 21, the second abutting section 672*d*2 is provided on the −Y axis direction end surface of the abutting section 672*d*. As shown in FIG. 21, the second abutting section 672*d*2 abuts against the end surface of the +Y axis direction side of the first convex section 432 which is provided in the first side surface 43 of the cartridge 4 in a state where the lever 672 is pushed down to the second position P2. The movement of the cartridge 4 in the +Y axis direction is regulated by the second abutting section 672*d*2 abutting against the end surface on the +Y axis direction side of the first convex section 432.

As shown in FIG. 19 and FIG. 20, the switch changing section 672*e* is provided to protrude to the −Y axis direction side (the rear surface side) with regard to the body section 672*a*. The switch changing section 672*e* changes a switch SW which is arranged at the −Y axis direction side of the lever 672.

The switch SW is used to determine the presence or absence of the sending and receiving of electric signals between the cartridge side terminal group 521 and the apparatus side terminal group 721. The switch SW has a body section 673 and a moving member 674. As shown in FIG. 21 and FIG. 23, the body section 673 is supported by a support plate 68*b* of the frame section 68. The moving member 674 is provided so as to protrude to the +Z axis direction side of the body section 673. For example, the moving member 674 is, for example, pressed to the +Z axis direction side and is provided to be able to move in the −Z axis direction according to a force in the −Z axis direction from outside. The arrow shown close to the moving member 674 of FIG. 19 conceptually shows the movement of the moving member 674.

As is possible to be understood from FIG. 19, FIG. 20, FIG. 21, and FIG. 23, the moving member 674 is arranged on a movement path of the switch changing section 672*e*. By the lever 672 moving in the −Z axis direction, the switch changing section 672*e* moves in the −Z axis direction and the moving member 674 is pressed down to the −Z axis direction side by the switch changing section 672*e*. In addition, by the lever 672 moving from this state in the +Z axis direction, the switch changing section 672*e* is moved in the +Z axis direction and the pressing force on the moving member 674 is released.

It is possible for the moving member 674 to enter a state where force in the −Z axis direction from outside does not act, that is, a state (a first state) where the moving member 674 is raised as shown in FIG. 19 and FIG. 23, and a state (a second state) where the moving member 674 is pushed down in the −Z axis direction side from the first state as shown in FIG. 20 and FIG. 21. Accordingly, the moving member 674 enters the first state in a state where the lever 672 is arranged at the first position P1 and the moving member 674 enters the second state in a state where the lever 672 is arranged at the second position P2. In this manner, the moving member 674 switches between the first state and the second state in conjunction with the position of the lever 672.

In the inner portion of the printer 10 (FIG. 1), there is provided a control section (which is not shown in the diagram) which controls the presence or absence of the sending or receiving of electric signals between the cartridge side terminal group 521 and the apparatus side terminal group 721. In a case where the switch SW is in the off state, that is, the moving member 674 is in the first state, signals are not sent from the body section 673 to the control section. In such a state, the control section which is provided in the inner portion of the printer 10 determines that it is not possible to perform the sending and receiving (conduction) of electric signals between the cartridge side terminal group 521 and the apparatus side terminal group 721 and controls so that the sending and receiving of electric signals between the cartridge side terminal group 521 and the apparatus side terminal group 721 and the printing operation are not performed. In addition, in a case where the switch SW is in the on state, that is, the moving member 674 is in the second state, a signal is sent from the body section 673 to the control section. In such a state, the control section which is provided in the inner portion of the printer 10 determines that the sending and receiving (conduction) of electric signals between the cartridge side terminal group 521 and the apparatus side terminal group 721 is to be performed and controls so that the sending and receiving of electric signals between the cartridge side terminal group 521 and the apparatus side terminal group 721 and the printing operation are performed.

In this manner, according to whether the switch SW is on or off, the printer 10 determines the presence or absence of the sending and receiving (conduction) of electric signals between the cartridge side terminal group 521 and the apparatus side terminal group 721 and is able to perform control in accordance with this.

Next, the operation where the cartridge 4 is mounted in the cartridge mounting section 6 will be described.

When the lever 672 is arranged at the second position P2, it is not possible to insert the cartridge 4 since the insertion opening 69 (refer to FIG. 2 and FIG. 3) of the cartridge mounting section 6 enters a state where a portion is closed off. As a result, when inserting the cartridge 4, the lever 672 is arranged in advance at the first position P1. After this, by completely inserting the cartridge 4 into the cartridge mounting section 6, the cartridge side terminal group 521 and the apparatus side terminal group 721 come into contact.

On the other hand, in this state, since the movement of the cartridge 4 is not regulated in the Y axis direction, it is possible to pull out the cartridge 4 by, for example, the user taking hold of the handle section 5 with a finger and pulling in the +Y axis direction. In addition, since the moving member 674 of the switch SW is in the first state, the exchange of electric signals is not performed between the cartridge 4 side and the printer 10 without conduction being performed between the cartridge side terminal group 521 and the apparatus side terminal group 721 even in a state where these are in contact.

After the cartridge 4 is mounted in the cartridge mounting section 6, the regulating section 672*c* is inserted into the handle section 5 by the lever 672 being pressed down from the first position P1 to the second position P2. As a result, the movement of the cartridge 4 is regulated by the second abutting section 672*d*2. As such, the pulling out of the cartridge 4 is regulated. Additionally, when the regulating section 672*c* is inserted into the handle section 5, the space of the handle section 5 is closed off by the regulating section 672*c*. In this case, not only is it not possible for the cartridge 4 to be functionally pulled out, but it is also easy to visually understand that it is not possible for the cartridge to be pulled out.

In addition, when the lever 672 is pressed down from the first position P1 to the second position P2, the moving member 674 enters the second state. As a result, the sending and receiving (conduction) of the electric signals is performed between the cartridge side terminal group 521 and the apparatus side terminal group 721.

As described above, according to the present embodiment, it is possible for the handle section 5 to combine the function as a handle when pulling out the cartridge 4 and the function as the regulating section for preventing the removal of the cartridge 4. Due to this, the number of components of the cartridge 4 and the printer 10 is reduced and it is possible to reduce the cost.

In addition, when the cartridge 4 is mounted in the cartridge mounting section 6 and the lever 672 is inserted into the handle section 5, the handle section 5 is closed off. As such, not only is it not possible for the cartridge 4 to be functionally pulled out, but it is also easy to visually understand that it is not possible for the cartridge 4 to be pulled out, and it is possible to more effectively achieve the function of preventing the cartridge 4 from being removed.

Furthermore, by providing the handle section 5 in the vicinity of the rear surface of the upper surface 43 of the cartridge 4, the regulating section for preventing the cartridge 4 from being removed is essentially provided at a position which is close to the surface of the printer 10. As such, it is possible to configure the mechanism which prevents the removal of the cartridge 4 with a simple configuration in which the user raises and lowers the lever 672, and it is possible to prevent an increase in the size of the printer 10.

In addition, according to the present embodiment, since the width of the handle section 5 is larger at the rear surface side than at the front surface side in a plan view of the upper surface 43 of the cartridge 4, there is a configuration where it is easy to take hold of the handle section 5 with a finger or the like when, for example, the user removes the cartridge 4.

In addition, according to the present embodiment, since the switch SW for detecting whether the cartridge 4 is mounted in the cartridge mounting section 6 is provided and the switch changing section 672*e* for turning on the switch SW when the lever 672 is pulled down to the second position P2 is provided in the lever 672, it is possible for the fixing of the cartridge 4 to be in conjunction with the operation of the switch SW.

Above, one applied example of the present invention has been described, but the present invention is not limited to the applied example and it is possible to adopt various configurations within a range which does not depart from the spirit thereof. For example, the following modifications are possible.

For example, in the embodiment described above, in the cartridge 4, the printing material containing section 450 is configured by a bag which has flexibility, but the ink may be directly contained in the case 9. That is, the inner walls of the case 9 may be the printing material containing section 450. In addition, the printing material containing section 450 may be configured by assembling the concave section which is provided in the inner wall of the case 9 and a film which seals the opening of the concave section.

In addition, in the embodiment described above, a case where the X axis direction is the left and right direction (the horizontal direction), the Y axis direction is the front and back direction (the horizontal direction), and the Z axis direction is the up and down direction (the vertical direction) has been described as an example, but the present invention is not limited to this.

Figure 25:
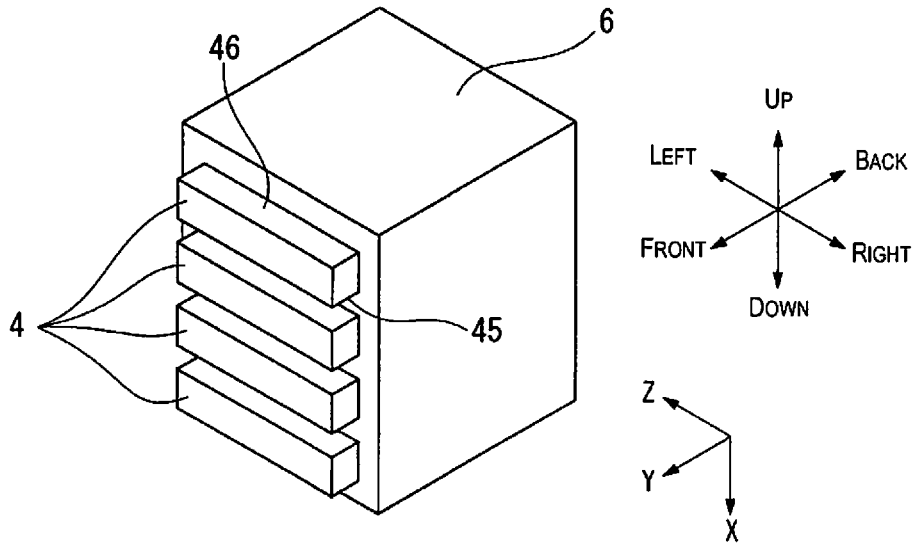
FIG. 25 is a fifth perspective diagram of the external appearance of the cartridge mounting section 6.

For example, as shown in FIG. 25, there may be a configuration where the cartridges 4 are arranged so as to be lined up in the up and down direction (the vertical direction). Here, in the configuration shown in FIG. 25, the cartridge 4 is inserted in a horizontal direction and the third side surface 45 and the fourth side surface 46 of the cartridge 4 enter a state which is parallel to the up and down direction (the vertical direction).

Figure 26:
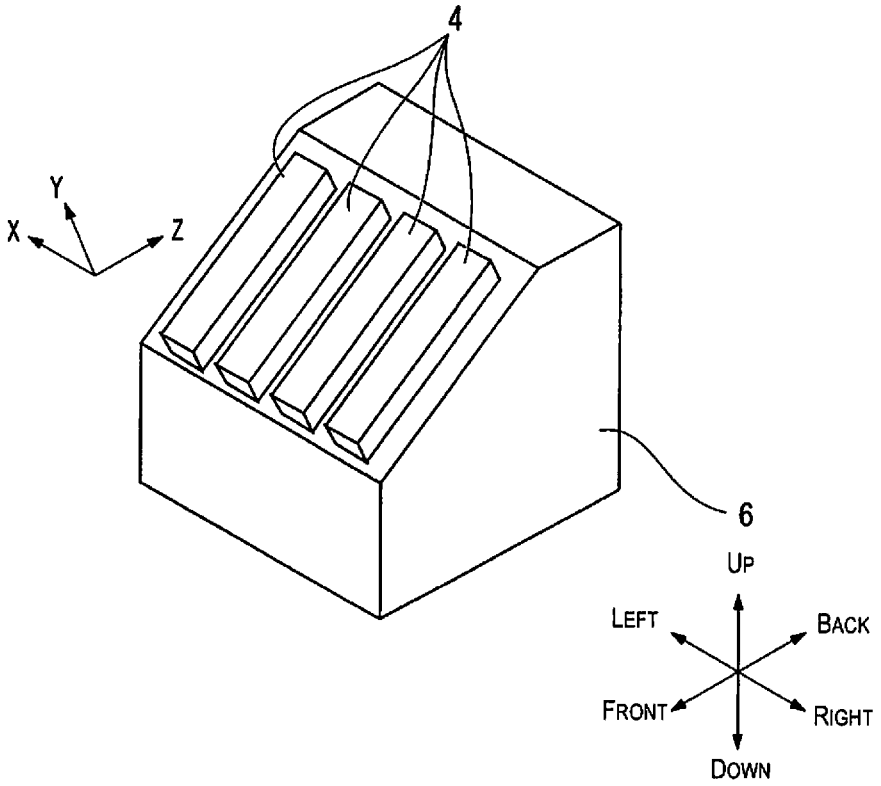
FIG. 26 is a sixth perspective diagram of the external appearance of the cartridge mounting section 6.
Figure 27:
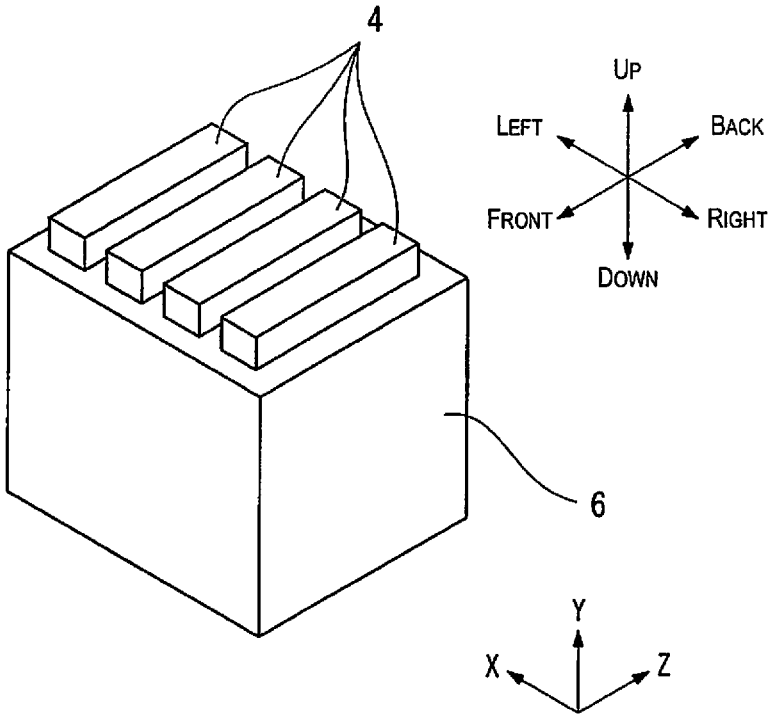
FIG. 27 is a seventh perspective diagram of the external appearance of the cartridge mounting section 6.

In addition, the embodiment described above has a configuration where the cartridge 4 is inserted in the horizontal direction, but, for example, as shown in FIG. 26, there may be a configuration in which the cartridge 4 is inserted in a direction which is inclined with regard to the horizontal direction. Furthermore, for example, as shown in FIG. 27, there may be a configuration in which the cartridge 4 is inserted in the vertical direction.

It is also possible to apply the present invention to an arbitrary printing apparatus which ejects a liquid other than ink and cartridges thereof without being limited to the ink jet printer and cartridges thereof. For example, application to the following various types of printing apparatus and cartridges thereof is possible.

(1) An image recording apparatus such as a facsimile apparatus (2) A printing apparatus which ejects coloring material which is used in the manufacturing of color filters for image display apparatuses such as liquid crystal displays (3) A printing apparatus which ejects electrode material which is used in the forming of electrodes such as an organic EL (electroluminescence) display, a surface emitting display (Field Emission Display, FED), or the like (4) A printing apparatus which ejects a liquid which includes bio organic matter which is used in bio chip manufacturing (5) A sample printing apparatus which is a precision pipette (6) A lubricant printing apparatus (7) A resin liquid printing apparatus (8) A printing apparatus which ejects lubricant in a pin point manner into precision machinery such as a watch or a camera (9) A printing apparatus which ejects a transparent resin liquid such as an ultraviolet curable resin liquid onto a substrate in order to form a micro hemispherical lens (an optical lens) or the like which is used in an optical communication element or the like

(10) A printing apparatus which ejects an acidic or alkaline etching liquid for etching a substrate or the like

(11) A printing apparatus which is provided with a liquid ejecting head which discharges liquid droplets in other arbitrary minute amounts Here, "liquid droplet" refers to a state of liquid which is discharged from a printing apparatus, and includes droplets which have a trail in a granular shape, a teardrop shape, or a thread shape. In addition, it is sufficient if the "liquid" as used here is a material which is able to be ejected by a printing apparatus. For example, it is sufficient if the "liquid" is a material in a state where a substance is in a liquid phase and the "liquid" includes materials in a liquid state with high or low viscosity, and materials in a liquid state such as sols, gel water, other inorganic solvents, organic solvents, solutions, liquid resins, and liquid metals (metal melts). In addition, the "liquid" includes not only liquids as a single substance state but also where particles of a functional material which is formed of solid matter such as a pigment or metal particles are dissolved, dispersed, or mixed into a solvent. In addition, typical examples of the liquid include ink as described in the embodiment described above, liquid crystals, or the like. Here, the ink includes various types of liquid compositions such as gel inks and hot melt inks in addition to typical water based inks and oil based inks.

What is claimed is:

1. An attachment member adapted to be mounted to a mounting section of a printing apparatus from an outside toward an inward direction of the printing apparatus, the mounting section extending from a connecting position of a printing material supply pipe arranged inside of the printing apparatus to the outside of the printing apparatus with a lever being disposed at a position closer to the outside, the attachment member comprising:

a front surface having a supply pipe insertion hole to which the printing material supply pipe is inserted; and an upper surface intersecting with the front surface, the upper surface including a concave section formed thereon so that a regulating section of the lever is inserted into the concave section when the attachment member is mounted to the mounting section.

2. The attachment member according to claim 1, wherein a width of the concave section in a direction perpendicular to a mounting direction of the attachment member is wider in a rear side than in a front side with respect to the mounting direction.

3. The attachment member according to claim 1, wherein the upper surface of the attachment member abuts a first abutting section of the regulating section of the lever when the attachment member is mounted to the mounting section.

4. The attachment member according to claim 1, wherein a movement of the attachment member in a mounting direction of the attachment member is regulated by a second abutting section of the regulating section of the lever when the attachment member is mounted to the mounting section.

5. The attachment member according to claim 1, wherein a space of the concave section is blocked off by the regulating portion of the lever when the attachment member is mounted to the mounting section.

6. The attachment member according to claim 1, wherein the concave section is formed in a vicinity of a rear end of the upper surface with respect to an insertion direction of the attachment member.

7. The attachment member according to claim 1, wherein a space of the concave section is blocked off by the regulating portion of the lever when the attachment member is mounted to the printing apparatus.

8. An attachment member adapted to be mounted to a printing apparatus having a mounting section provided with a lever, the attachment member comprising:

a front surface disposed on a front side in a mounting direction to the mounting section;

a rear surface facing the front surface; and an upper surface intersecting with the front surface and the rear surface, the upper surface including a concave section formed therein so that a regulating section of the lever is inserted in the concave section when the attachment member is mounted to the printing apparatus.

9. The attachment member according to claim 8, wherein a width of the concave section in a direction perpendicular to a mounting direction of the attachment member is wider toward a rear surface side than a front surface side.

10. The attachment member according to claim 9, wherein the upper surface of the attachment member abuts a first abutting section of the regulating section of the lever when the attachment member is mounted to the printing apparatus.

11. The attachment member according to claim 10, wherein a movement of the attachment member in the mounting direction is regulated by a second abutting section of the regulating section of the lever when the attachment member is mounted to the printing apparatus.

12. The attachment member according to claim 11, wherein the concave section is formed in the upper surface in a vicinity of the rear surface.

* * * * *